US009970264B2

(12) United States Patent
Tulloch

(10) Patent No.: US 9,970,264 B2
(45) Date of Patent: May 15, 2018

(54) DOWNHOLE ACTUATION APPARATUS AND ASSOCIATED METHODS

(71) Applicant: NOV Downhole Eurasia Limited, Gloucestershire (GB)

(72) Inventor: Rory McCrae Tulloch, Aberdeen (GB)

(73) Assignee: NOV DOWNHOLE EURASIA LIMITED, Gloucestershire (GB)

( * ) Notice: Subject to any disclaimer, the term of this patent is extended or adjusted under 35 U.S.C. 154(b) by 412 days.

(21) Appl. No.: 14/730,091

(22) Filed: Jun. 3, 2015

(65) Prior Publication Data

US 2015/0345256 A1 Dec. 3, 2015

(30) Foreign Application Priority Data

Jun. 3, 2014 (GB) ..... 1409872.7

(51) Int. Cl.

| | |
|---|---|
| ***E21B 23/00*** | (2006.01) |
| ***E21B 41/00*** | (2006.01) |
| ***E21B 10/00*** | (2006.01) |
| ***E21B 10/26*** | (2006.01) |
| ***E21B 23/01*** | (2006.01) |
| ***E21B 25/00*** | (2006.01) |
| ***E21B 33/12*** | (2006.01) |
| ***E21B 34/06*** | (2006.01) |
| ***E21B 34/14*** | (2006.01) |

(52) U.S. Cl.

CPC ..... *E21B 41/00* (2013.01); *E21B 10/00* (2013.01); *E21B 10/26* (2013.01); *E21B 23/00* (2013.01); *E21B 23/01* (2013.01); *E21B 25/00* (2013.01); *E21B 33/12* (2013.01); *E21B 34/06* (2013.01); *E21B 34/14* (2013.01)

(58) Field of Classification Search

CPC ..... E21B 23/004; E21B 23/006
USPC ..... 166/331, 332.1, 334.1, 240, 318
See application file for complete search history.

(56) References Cited

U.S. PATENT DOCUMENTS

| | | | | |
|---|---|---|---|---|
| 3,086,587 | A * | 4/1963 | Zandmer | E21B 33/138 166/243 |
| 3,269,463 | A | 8/1966 | Page, Jr. | |
| 3,332,498 | A | 7/1967 | Page, Jr. | |
| 3,568,768 | A | 3/1971 | Rowell, Jr. | |
| 4,887,676 | A | 12/1989 | Hallez | |
| 5,758,726 | A | 6/1998 | Streich et al. | |
| 5,775,428 | A | 7/1998 | Davis et al. | |
| 6,220,360 | B1 | 4/2001 | Connell et al. | |
| 7,100,700 | B2 | 9/2006 | Davis et al. | |
| 7,624,810 | B2 | 12/2009 | Fould et al. | |
| 7,770,652 | B2 | 8/2010 | Barnett | |
| 8,739,864 | B2 * | 6/2014 | Crider | E21B 21/103 166/240 |
| 9,719,321 | B2 * | 8/2017 | Hern | E21B 33/16 |
| 2008/0105465 | A1 | 5/2008 | Radford et al. | |
| 2011/0174505 | A1 | 7/2011 | Gill et al. | |

(Continued)

*Primary Examiner* — Kenneth L Thompson
(74) *Attorney, Agent, or Firm* — Conley Rose, P.C.

(57) ABSTRACT

A downhole actuating apparatus for actuating downhole. The apparatus is actuatable at the downhole location at, upon or during one or more particular cycle/s selectable from a sequence of cycles according to a predetermined selection. The downhole actuation comprises the release of at least one flowable object from the downhole location. The apparatus releases the at least one flowable object from the downhole location at, upon or during the particular cycle selectable from the sequence of cycles.

31 Claims, 15 Drawing Sheets

(56) References Cited

U.S. PATENT DOCUMENTS

| | | | |
|---|---|---|---|
| 2013/0192897 | A1 | 8/2013 | MacKenzie et al. |
| 2014/0008127 | A1 | 1/2014 | Plessis et al. |
| 2015/0176355 | A1 | 6/2015 | Trinh et al. |

* cited by examiner

DOWNHOLE ACTUATION APPARATUS AND ASSOCIATED METHODS

CROSS-REFERENCE TO RELATED APPLICATION

This application claims the benefit of GB Patent Application No. 1409872.7, filed on 3 Jun. 2014, the entire contents of which are hereby incorporated by reference.

FIELD OF INVENTION

The present invention relates to downhole actuation apparatus and associated methods. In particular, but not exclusively, the present invention relates to downhole actuation, such as of a valve by a ball from a ball-dropper, according to predetermined operating conditions or cycles.

BACKGROUND

In the oil and gas industry apparatus is typically run in downhole on strings, such as drill strings, wire strings, coil tubing strings, or the like. Many downhole operations require the actuation of equipment in downhole locations at specific phases or positions of downhole operations.

Actuation of tools downhole is commonly achieved through various means. For example, downhole actuation may occur at a predetermined location such as a depth or relative to other downhole apparatus or features, such as when a tool being run-in reaches a previously-positioned tool or feature.

Other forms of downhole actuation involve remote actuation, such as from surface. Forms of remote actuation from surface include the use of flowable objects transported by fluid in a bore, pressure pulses or variations in properties of a fluid transported in a bore, hydraulic control by hydraulic lines, or signals sent by other means from surface. Examples of flowable objects transported by a fluid in a bore include drop balls, darts, plugs, RFID tags, or the like. Such flowable objects are inserted into the bore and transported to a downhole location by a flow of fluid (and typically gravity) in the bore when it is desired to use such flowable objects to actuate a downhole tool.

Downhole actuation is used to actuate various apparatus, such as valves. The valves may be for varying restriction sizes or for opening or closing ports, such as to redirect fluid to different flow paths or to actuate other apparatus.

SUMMARY OF INVENTION

According to a first aspect of the present invention there is provided a downhole actuating apparatus for actuating downhole. The apparatus may be actuatable at the downhole location at, upon or during one or more particular cycle/s selectable from a sequence of cycles according to a predetermined selection. The downhole actuation may comprise the release of at least one flowable object from the downhole location. The apparatus may be configured to release the at least one flowable object from the downhole location at, upon or during the particular cycle selectable from the sequence of cycles.

The apparatus may comprise a controller for controlling the release of the flowable object at, upon or during the predetermined cycle selectable from the sequence of cycles. The controller may comprise a mechanical controller. The controller may comprise a fluid operated controller.

The apparatus may comprise the flowable object releasable at, upon or during the predetermined cycle selectable from the sequence of the plurality of cycles.

The apparatus may be reconfigurable such that the predetermined cycle selected from the sequence of cycles varies between configurations. The apparatus may be reconfigurable between operations, such as between trips. The apparatus may be reconfigurable at surface, such as before or during string assembly and/or run-in. The apparatus may only be reconfigurable at surface.

The apparatus may be reconfigurable to allow variation of the particular predetermined cycle between different downhole trips. For example, the particular predetermined cycle may comprise a different position in the sequence for different downhole trips (e.g. a second position in a sequence of cycles during a first downhole trip and a first position in the sequence of cycles during a second downhole trip).

The flowable object maybe releasable into a flowpath, such as of a fluid flowing axially (e.g. downhole). The flowpath may be substantially internal, such as in a throughbore. Alternatively, the flowpath be substantially external, such as in an annulus or chamber external to the throughbore.

The flowable object may comprise an actuating member. The flowable object may comprise one or more of: a drop-ball/s, a dart/s, a plug/s, an RFID tag/s, or the like.

The predetermined cycle may comprise a discrete predetermined cycle selectable from the sequence of the plurality of cycles. The plurality of cycles may comprise a plurality of discrete similar cycles.

The predetermined cycle may comprise a discrete particular cycle, such as selectable from a first, second or third cycle. The apparatus may be configurable to release the flowable object at, upon or during the particular cycle (e.g. a first or a second or a third cycle) selected from the plurality of cycles.

The apparatus may be fluid-actuated or fluid-controlled. The release of the flowable object may be triggered by a fluid cycle or operation. The actuating, controlling or triggering fluid may be in the throughbore (e.g. flow through the throughbore). The fluid may comprise a wellbore fluid. The fluid may comprise a drilling fluid. The fluid may comprise an injection fluid.

The one or more cycles may comprise one or more fluid cycles, such as resulting from or relating to varying fluid pressure and/or fluid flow rate. The apparatus may be cycled between at least a first fluid condition and a second fluid condition. For example, the first fluid condition may comprise a first fluid pressure and/or flow rate and the second fluid condition may comprise a second fluid pressure and/or flow rate. The/each operating sequence/s may comprise full fluid flow, such as maximum fluid flow and/or pressure. The first fluid condition may correspond to a pumps-off condition and the second fluid condition may correspond to a pumps-on condition (or vice-versa).

The predetermined sequence may be determined at surface. The apparatus may be configurable at surface, such as by an operator, to actuate upon one or more of the plurality of cycles. The apparatus may be configurable at surface to release a flowable object from the downhole location at, upon or during the selected cycle from the plurality of cycles. The predetermined sequence may be selected prior to or during string assembly, before or during string run-in.

The apparatus may comprise a plurality of positions for the flowable object/s, each object position corresponding to a particular cycle. For example, the apparatus may comprise "n" object positions corresponding to "n" cycles, where "n"

is a whole number greater than 1 (e.g. 2, 3, 4, 5 or 6, etc.). The "n−1" object position may correspond to the "n−1" cycle, the "n-2" object position may correspond to the "n−2" cycle, etc. The flowable object may be locatable at a selected object position to correspond to the predetermined operating sequence. For example, the flowable object may be located at a "n−2" object position where it is selected to release the flowable object at, upon or during the "n−2" cycle. The apparatus may comprise a plurality of ports, chambers or berths for the flowable object, each port, chamber or berth corresponding to each object position. The controller may define the plurality of positions for the flowable object/s.

The apparatus may be configured or reconfigurable to accommodate different flowable objects in the port, chamber or berth. For example, the port, chamber or berth may be configured or reconfigurable to accommodate drop-balls of various shapes, materials or sizes. Each port, chamber or berth may be configurable to accommodate different flowable objects. For example, a drop-ball of a smaller diameter may be accommodated in an earlier position than one or more drop-balls of larger diameter/s accommodated in subsequent position/s. Accordingly, the first drop-ball may pass through a larger seat/s before being received at a smaller seat or receiving location downhole or downstream of the larger seat/s and the larger diameter/s drop-ball/s may be subsequently released during a later cycle/s for effect or actuation at the larger diameter seat/s.

The sizes of the drop-ball/s may be varied up to a maximum cavity space available within the/each port, berth or chamber.

Multiple positions may correspond to a similar respective phase of multiple cycles. For example, multiple positions may correspond to respective first phases or initiations of the multiple cycles. The apparatus may be configured to release the flowable object/s at a similar phase, stage, juncture or point of each of the plurality of cycles. For example, the apparatus may be configured to always release the flowable object/s at/upon or during a particular stage of each cycle. The apparatus may be configured to release the flowable object/s at the same particular stage of each cycle (e.g. whenever the apparatus is cycled to a second fluid condition during each cycle).

The object positions may be sequentially arranged. The object positions may be axially spaced. A first object position may be located at a first axial portion or position of the apparatus. A second object position may be located at a second axial portion or position of the apparatus. Additionally or alternatively, the object positions may be circumferentially spaced. The object positions may be axially arranged. The object positions may be circumferentially arranged. The object positions may be evenly axially distributed. The object positions may be evenly circumferentially distributed.

In use, the apparatus may be configurable such that not all cycles of the sequence of cycles correspond to or result in the release of a flowable object. In use, the apparatus may be configurable such that not all of the object positions comprise a flowable object, such as for running-in downhole prior to actuation. At least one of the cycles of the sequence of cycles may be selected for non-actuation. At least one of the object positions may be selected for redundancy or non-use. In some configurations, a single position corresponding to a single cycle in the sequence of cycles may be selected for release of the flowable object. The redundant or non-used object position/s may be variable, such as according to operator selection (e.g. for different applications and/or operators). In some applications, and/or for some operators, it may be desirable to allow a particular operation sequence (e.g. a fluid cycle) without the release of a flowable object. For example, a particular operator may wish to test pumps by turning on/off, without necessarily releasing a flowable object at, upon or during such a first fluid cycle. Accordingly, one or more object position/s (e.g. the first) may selectively be vacant without a flowable object. The apparatus may allow downhole operations when not in use, such as before and/or after the sequence of cycles. Accordingly, the apparatus may allow additional cycles, such as additional full flow or pressure cycles, prior to actuation. The additional cycles may be considered additional when compared to, for example, conventional downhole actuators or initially locked apparatus, such as mechanically-locked apparatus (e.g. with shear pins, shear rings, dogs, frangible members, or the like). The apparatus may comprise a lock. For example, the apparatus may comprise a mechanical lock to prevent cycling prior to deactivation of the lock. The lock may be fluid actuated, such as by fluid pressure and/or flow being increased above a threshold. Accordingly, the apparatus may permit fluid flow below the threshold prior to initiation of the sequence of cycles that determine the release of the flowable object. The sequence of cycles may require a higher fluid flow and/or pressure for a phase of each cycle relative to a lower fluid flow and/or pressure for a different phase of each cycle. The higher fluid flow and/or pressure may be below (or at least not required to be above) the threshold. Alternatively, the higher fluid flow and/or pressure may be above the threshold.

A single flowable object may be located at a selected one of the object positions. The apparatus may comprise a single flowable object. Accordingly, only the single flowable object may be released during the plurality of cycles, the single flowable object being released at the $n^{th}$ cycle of the sequence of plurality cycles according to a preselection.

The apparatus may be configurable to release a plurality of flowable objects. The apparatus may be configurable to release the plurality of flowable objects sequentially. The apparatus may be configurable to release each of the plurality of flowable objects at, upon or during a respective cycle, such as a discrete respective operation. For example, the apparatus may be configurable to release a first flowable object at, upon or during a second cycle; and to release a second flowable object at, upon or during a third or fourth cycle. A single flowable object may be selectively located at a plurality of the object positions. The apparatus may be configurable to release a discrete flowable object at, during or upon each cycle of the sequence of cycles. The apparatus may be configurable to release a discrete flowable object at, during or upon a selected pattern of cycles of the sequence of cycles. For example, for a particular operation, the apparatus may be configured to only release flowable objects at, on or during the $n^{th}$, $n-1^{th}$, n−3 cycles. The selected pattern may comprise any whole number of cycles up to and including the total number of the sequence of cycles.

The apparatus may comprise a ball-dropper.

The apparatus may be configured to release one or more drop-ball(s) into a flowpath. The flowpath may be defined by a bore, such as the throughbore.

The apparatus may be configured to release the/each drop-ball(s) at the/each predetermined operation cycle(s).

The apparatus may comprise a multi-cycle downhole ball-dropper for dropping a ball from a downhole location, such as downhole or downstream of a downhole restriction, at or upon an $n^{th}$ cycle of a sequence of cycles wherein "n" is selectable from the sequence of cycles. The downhole restriction may comprise a valve, motor (e.g. a positive displacement motor), and/or other downhole apparatus. The ball-dropper may be for dropping a ball to another downhole location, such as a seat downstream of the ball-dropper. The apparatus may be reconfigurable to vary "n". The apparatus may be reconfigurable to vary "n" for different operations, such as for different or discrete downhole trips. For example, for a first particular downhole application or a first particular operator, "n" may be selected to correspond to a particular cycle of a sequence of cycles. For a second particular application or a second particular operator, "n" may be selected to correspond to a different (e.g. earlier or later) cycle of the sequence of cycles. The apparatus may be configurable to vary "n" at surface.

The apparatus may be configured to bias the flowable object/s towards the flowpath. For example, the apparatus may comprise biasing means, such as a spring, piston, resilient member, or the like, for biasing the flowable object towards the flowpath. The apparatus may be configured to bias the flowable object towards the flowpath from a low side of the flowpath. For example, the apparatus may be configured to bias and/or transit the flowable object into a flowpath from a low side of a flowpath, such as in a deviated or horizontal bore (e.g. against gravity). The biasing means may be configured to bias the flowable object towards the flowpath without the biasing means extending into the flowpath before, upon, during and/or after biasing of the flowable object towards the flowpath. The biasing means may be dimensioned so as not to extend into the flowpath before, upon, during and/or after biasing of the flowable object towards the flowpath. The biasing means may be configured to propel the flowable object into the flowpath. The biasing means may move the flowable object into the flowpath at, upon or during the predetermined operation sequence.

The biasing means may be comprised in or with the port, chamber or berth for the flowable object. Each port, chamber or berth may comprise biasing means. Each port, chamber or berth may comprise a discrete biasing means.

The/each port, chamber or berth may be accessible from or via the flowpath, such as by movement of the indexer in the throughbore. The/each port, chamber or berth may be accessible externally. The/each port, chamber or berth may be accessible externally to allow configuration of the apparatus by inserting a flowable object into the/each selected port, chamber or berth. The/each port, chamber or berth may be accessible via a sealable opening. Such external accessibility may facilitate the configuration or reconfiguration of the apparatus, such as prior to, during or even after string assembly, such as at surface/wellhead.

The apparatus may comprise an indexer.

The indexer may comprise an indexing mechanism.

The indexer may be configured to progress from a first indexing point to a second indexing point. The indexer may be axially biased, such as by a piston and/or a resilient member, such as a spring, elastomer or the like. The indexer may be biased from the second indexing point towards the first indexing point.

The indexer may be configured to sequentially progress from a particular indexing position corresponding to a respective cycle in the sequence to a next indexing position corresponding to the next respective cycle in the sequence. The indexer may be configured to sequentially progress from a first position corresponding to a first cycle in the sequence to a second position corresponding to a second cycle in the sequence. Each indexing position may comprise a respective first and second indexing point.

The first indexing points of each indexing position may be rotationally aligned. Accordingly the first indexing positions may be arranged or distributed along a linear axis in the axial direction of a downhole tool. Similarly, the second indexing points of multiple/each indexing position/s may be rotationally aligned.

Alternatively, the first and/or second indexing points of each/multiple indexing positions may be rotationally misaligned. For example, the respective indexing points of each position may be helically arranged. Each indexing position corresponding to a respective cycle may comprise the indexer in a different rotational and/or axial location. The indexing sleeve may be supported at each respective first and/or second indexing point by a support member in addition to the indexing pin/s. The support member may comprise an axial stop/s, such as a shoulder/s, configured to engage a corresponding support/s on an axially fixed member, such as a housing for the indexing sleeve. Each indexing position may comprise a respective support member. The support members may be arranged in a similar pattern to the arrangement of the respective indexing points. For example, the support members may be helically arranged.

The indexer may be configured to sequentially index according to a predetermined operating parameter. The predetermined operating parameter may comprise a fluid condition, such as fluid flow and/or pressure. Each first indexing point may correspond to a first predetermined operating parameter and each second indexing point may correspond to a second predetermined operating parameter.

The indexing mechanism may comprise a cam member and a cam follower member.

The indexing mechanism may comprise an indexing pin and an indexing sleeve having a slot, wherein the indexing pin engages the slot. The indexing pin may extend at least partially into the slot.

The slot may extend at least partially through the indexing sleeve.

The slot may define the cycles having at least two sequential indexing points, wherein each indexing point corresponds to an operational state or condition. Each cycle may define the at least two indexing points.

The slot may define a finite path. The slot may define a helically arranged path. The indexing mechanism may be configured to transition from an initial axial and/or radial position to a final axial and/or radial position through the plurality of cycles. Upon completion of the plurality of cycles the indexer may be effectively locked or inactuatable in the final position corresponding to the final cycle of the plurality of cycles. Upon completion of the plurality of cycles, the apparatus may be configured to permit further cycling operations that do not trigger the actuating apparatus (e.g. do not result in the further cycling or reverse cycling of the indexer). The indexer may be reset or reconfigured, such as at surface following retrieval.

The indexer may be configured to sequentially progress in a single rotational direction. The indexer may be configured to sequentially progress between positions in a first axial direction corresponding to a first rotational direction. The indexer may be configured to sequentially progress between positions in a single rotational direction corresponding to a single axial direction. The indexer may be configured to sequentially progress between indexing points in a single rotational direction. The indexer may be configured to sequentially progress between indexing points in different axial directions. For example, the indexer may progress from the first indexing point/s to the second indexing point/s in a first axial direction and progress from the second indexing point/s to the next first indexing point/s (of the next indexing position/s) in a second axial direction, the first and second axial directions being opposite.

The apparatus may be configured to actuate a valve. Accordingly the apparatus may selectively operate a valve according to the predetermined operation sequence. For example, the apparatus may be configured to close, open or otherwise alter a valve operating.

The valve may comprise a bypass valve. The valve may be configured to provide a bypass flowpath. The valve may be configured to actuate (and/or deactuate) a downhole tool. The valve may be configured to create and/or vary a pressure differential upon actuation.

It will be appreciated that the apparatus may be moved and/or moving, such as downhole (or uphole) before, during and/or after cycling.

According to a further aspect of the present invention there is provided a method of actuating a downhole apparatus, the method comprising:

configuring an actuator by selecting a cycle from a sequence of cycles for the actuator to actuate at, upon or during said cycle;

running-in the actuator to a downhole location with the downhole actuator in the predetermined configuration; and actuating the downhole actuator at the downhole location at, upon or during the preselected cycle.

The method may comprise selecting the cycle from any of the sequence of cycles. The method may comprise varying the selected cycle for different trips and/or for different operators.

The method may comprise releasing at least one flowable object from a downhole location at, upon or during the predetermined cycle selected from the sequence.

The method may comprise running in the flowable object prior to release.

The method may comprise locating the flowable object downhole of a restriction prior to release, such as running in the flowable object below the restriction.

According to a further aspect of the present invention there is provided a multi-cycle downhole ball-dropper for dropping a ball from a downhole location, wherein the ball-dropper is reconfigurable to drop the ball at, during or upon a selected cycle of a sequence of cycles wherein the selected cycle is selectable from a plurality of cycles.

The downhole location may be downhole or downstream of a downhole restriction.

The selected cycle may be the $n^{th}$ cycle of the sequence of cycles. "n" may be variable according to operator selection. The selected cycle may be predetermined, such as prior to running-in (e.g. at surface/wellhead) by the operator.

The apparatus may be configured to release one or more drop-ball(s) into a flowpath and/or bore. The flowpath may be defined by the bore, such as a throughbore.

The apparatus may be configured to release the/each drop-ball(s) at the/each predetermined cycle(s).

The apparatus may comprise a multi-cycle downhole ball-dropper for dropping a ball at a downhole location, such as downhole or downstream of a downhole restriction, at or upon an $n^{th}$ cycle of a sequence of cycles wherein "n" is selectable from a plurality of cycles. The ball-dropper may be for dropping a ball to another downhole location, such as a seat downstream of the ball-dropper. The apparatus may be reconfigurable to vary "n". The apparatus may be reconfigurable to selectively vary "n" for different operations, such as for different operation sequences. For example, for a first particular application or a first particular operator, "n" may be selected to correspond to a particular cycle (e.g. first, second or third) of a sequence of cycles. For a second particular application and/or a second particular operator, "n" may be selected to correspond to a different particular cycle (e.g. earlier or subsequent cycle) of the sequence of cycles. The apparatus may be configurable to vary "n" at surface, such as at a rigsite prior to or during string assembly and/or run-in.

According to a further aspect of the present invention there is provided a method of dropping a ball from a downhole location, the method comprising:

configuring a ball-dropper by selecting a cycle from a sequence of cycles for the ball-dropper to release a ball at, upon or during said cycle;

running-in the ball-dropper to a downhole location with the ball-dropper in the predetermined configuration; and actuating the downhole ball-dropper at the downhole location at, upon or during the preselected cycle.

The method may comprise locating the ball-dropper downhole or downstream of a restriction prior to release of the ball. The method may comprise dropping the ball to another downhole location, such as a seat downstream of the ball-dropper.

The method may comprise reducing the time between a decision or command at surface to release a drop-ball and the receipt of the drop-ball at the desired location downhole, relative to a corresponding time for the release of a drop-ball from surface or another uphole location.

According to a further aspect of the present invention there is provided a downhole apparatus for downhole actuating, the apparatus being configured to release at least one flowable object from a downhole location, wherein the apparatus is configured to bias the flowable object/s towards a flowpath.

The apparatus may comprise a biasing means, such as a spring, piston, resilient member, or the like, for biasing the flowable object towards the flowpath. The apparatus may be configured to bias the flowable object towards the flowpath from a low side of the flowpath. For example, the apparatus may be configured to bias and/or transit the flowable object into a flowpath from a low side of a flowpath, such as in a deviated or horizontal bore (e.g. against gravity). The biasing means may be configured to bias the flowable object towards the flowpath without the biasing means extending into the flowpath before, upon, during and/or after biasing of the flowable object towards the flowpath. The biasing means may be dimensioned so as not to extend into the flowpath before, upon, during and/or after biasing of the flowable object towards the flowpath. The biasing means may be configured to propel the flowable object into the flowpath. The biasing means may move the flowable object into the flowpath at, upon or during the predetermined operation sequence.

According to a further aspect of the present invention there is provided a method of releasing a flowable object downhole, the method comprising: restraining a flowable object from flowing in a flowpath; biasing the flowable object towards the flowpath; and releasing the flowable object from a downhole location into the flowpath.

The method may comprise laterally or transversely biasing the flowable object towards the flowpath. The method may comprise radially biasing the flowable object towards the flowpath. The method may comprise biasing the flowable object against gravity towards the flowpath. The method may comprise transversely biasing the flowable object towards an axial flowpath, such as an axial flowpath defined by a throughbore in a downhole apparatus.

According to a further aspect of the present invention there is provided a downhole valve, wherein the valve is reconfigurable or actuatable at, upon or during a particular cycle selectable from a sequence of cycles according to a predetermined selection.

Reconfiguration or actuation may comprise redefining one or more flow paths or ports through the valve. The valve may comprise a bypass valve. Reconfiguration or actuation may comprise closing one or more bypass ports. Reconfiguration may comprise closing the valve.

According to a further aspect of the present invention there is provided a method of actuating or reconfiguring a downhole valve at a downhole location, the method comprising pre-selecting a cycle from a sequence of cycles for the valve to be reconfigured or actuated at, upon or during said cycle; and actuating or reconfiguring the valve at the downhole location at, upon or during the preselected cycle.

The method may comprise varying the pre-selected cycle in the sequence for different downhole trips, operators and/or operations.

According to a further aspect of the present invention, there is provided a downhole toolstring comprising the apparatus of any other aspect/s.

The downhole toolstring may comprise one or more tools selected from: a packer; an anchor; a whipstock; a sidetracking tool; a coring tool; a downhole motor, such as a positive displacement motor; a reamer; a drillbit; a running tool; a MWD tool.

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to any of the other aspects, without the need to explicitly and unnecessarily list those various combinations and permutations here. For example, features recited with respect to an actuation apparatus of one aspect may be applicable to a ball-dropper of another aspect, and vice-versa; and the same applies to a flowable object of one aspect and a drop-ball of another aspect. Similarly the features recited in respect of any apparatus aspect may be similarly applicable to a method aspect, and vice-versa. For example, the apparatus may be configured to perform any of the functions or steps of a method aspect; and/or a method aspect may comprise any/all of the functions or steps associated with an apparatus aspect.

In addition, corresponding means for performing one or more of the discussed functions are also within the present disclosure.

It will be appreciated that one or more embodiments/aspects may be useful in downhole actuation. In particular it will be appreciated that one or more embodiments/aspects may be useful in the release of flowable object/s downhole such as below a flow restriction's and/or to save time between command/release of the flowable object/s and the receipt of the flowable object at a desired location or seat.

The above summary is intended to be merely exemplary and non-limiting.

As used herein, the term "comprise" is intended to include at least: "consist of"; "consist essentially of"; "include"; and "be". For example, it will be appreciated that where the controller may "comprise an indexer", the controller may "include an indexer" (and optionally other element/s); the controller "may be an indexer"; or the controller may "consist of an indexer"; etc. For brevity and clarity not all of the permutations of each recitation of "comprise" have been specifically stated. Similarly, as used herein, it will be appreciated that "downhole" and "uphole" do not necessarily relate to vertical directions or arrangements, such as when applied in deviated, non-vertical or horizontal bores.

BRIEF DESCRIPTION OF THE DRAWINGS

These and other aspects of the present invention will now be described, by way of example, with reference to the accompanying drawings, in which.

DESCRIPTION OF THE DRAWINGS

Figure 1:
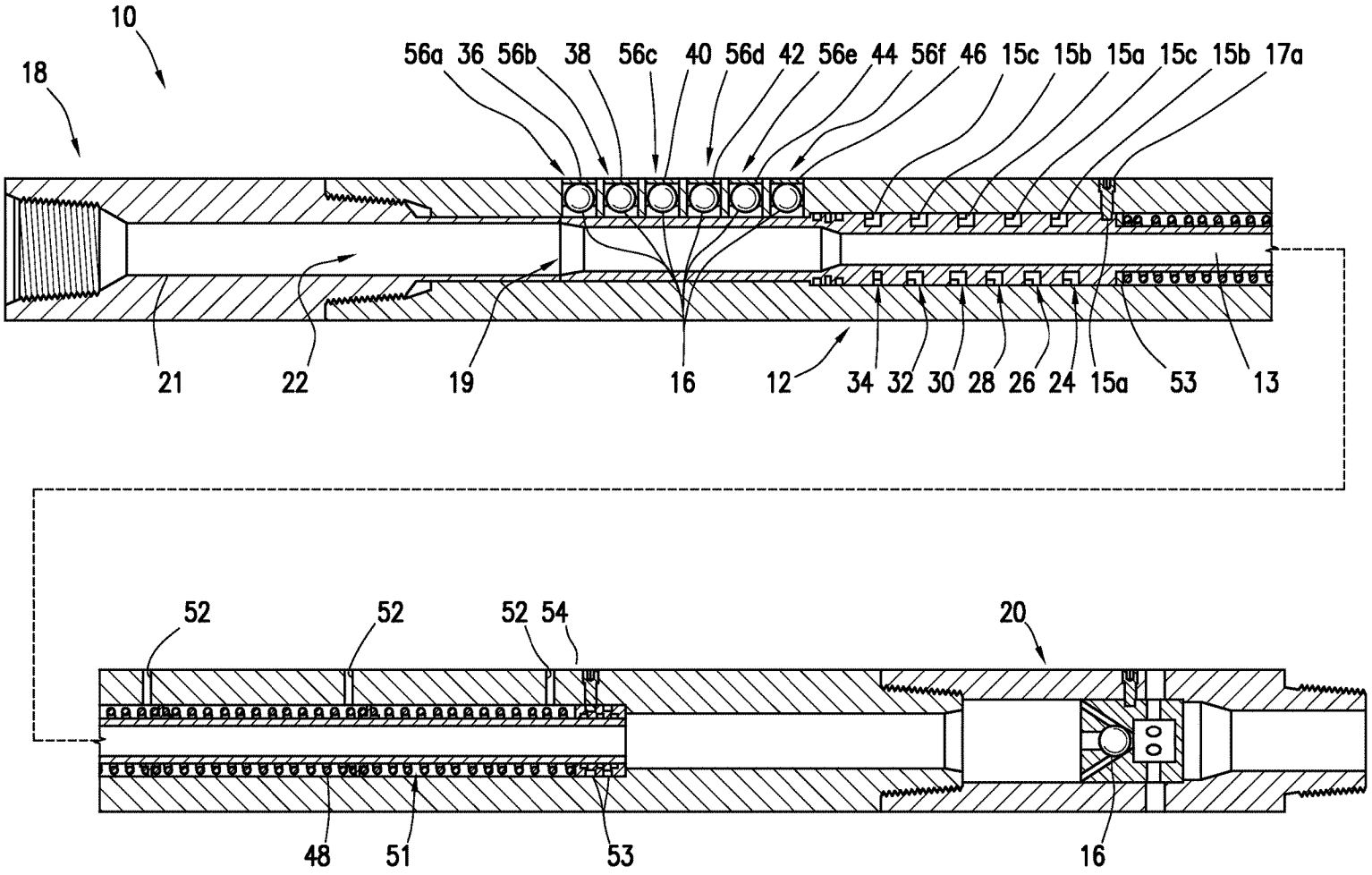
FIG. 1 is a schematic sectional view of an embodiment of an apparatus according to the invention incorporated in a portion of a toolstring.
Figure 2:
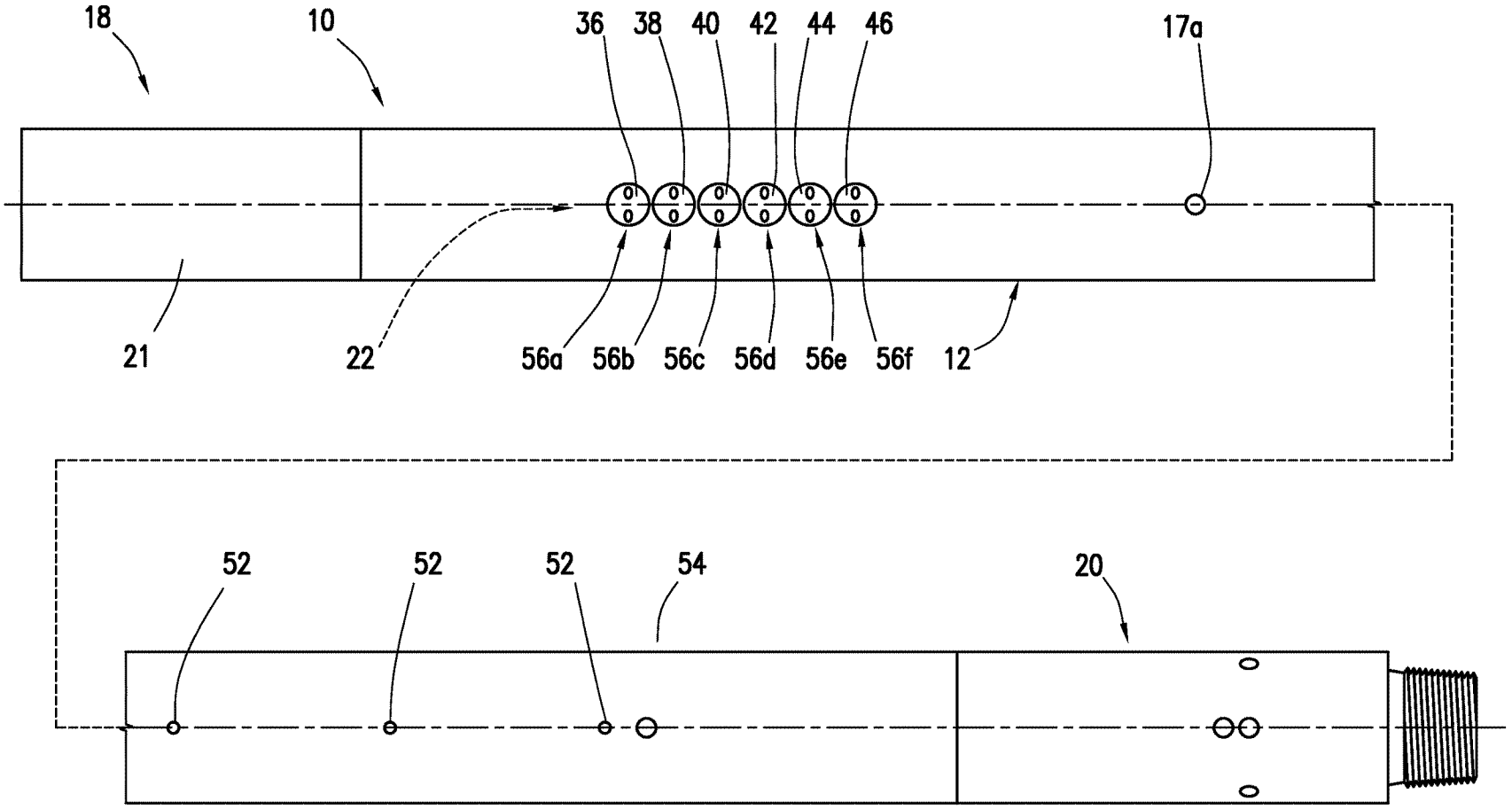
FIG. 2 is a side view of the apparatus shown in FIG. 1.

FIGS. 1 and 2 show a downhole actuating apparatus 10 in accordance with a first embodiment of the present invention. The apparatus 10 shown comprises a controller embodied here in the form of an indexer 12 in a housing 14, and one or more flowable objects shown here as a plurality of drop-balls 16.

In the particular embodiment shown, six indexing positions 24, 26, 28, 30, 32, 34 correspond to release positions for a drop-ball 16 from each of six berths 36, 38, 40, 42, 44, 46. It will be appreciated that in practical applications less drop-balls 16 may be present than shown; and drop-balls 16 are shown here at every berth 36, 38, 40, 42, 44, 46 corresponding to every indexing position 24, 26, 28, 30, 32, 34, and also seated following release, for illustrative purposes. In many applications, only a single drop-ball 16 may be present—located at any of the positions shown in FIG. 1 according to a berth 36, 38, 40, 42, 44, 46 selection and a stage of operation. For example, it will be appreciated that the seated ball 16 shown in FIG. 1 is purely illustrative and would require the indexer 12 to be progressed through at least a first cycle corresponding to the first indexing position 24 (not yet shown in FIG. 1). It will also be appreciated that other flowable objects, such as drop-balls 16 of different or varying diameters, may be accommodated in the apparatus 10 in other configurations or embodiments.

In use, the apparatus 10 is actuatable at a downhole location at, upon or during one or more particular cycle/s selectable from a sequence of cycles according to a predetermined selection, as will be described in detail below.

The apparatus 10 of FIGS. 1 and 2 is connected in a portion of a toolstring 18, shown here with the apparatus 10 mounted above a bypass valve 20 and below a running tool 21. The connection can be via conventional connections, such as pin and box threaded connections, so that the apparatus 10 may be inserted or connected in toolstrings with conventional or existing tools above and/or below the apparatus. The apparatus comprises a throughbore 22 in fluid communication with the adjacent tools 20, 21. In the embodiment shown, the throughbore 22 defines an internal flowpath for receiving the ball 16 when released.

The indexer 12 shown comprises a cam and cam follower in the form of a sleeve 13 with three parallel discontinuous slots 15*a*, 15*b* and 15*c* corresponding pins 17*a*, 17*b*, 17*c* that engage the respective slots 15*a*, 15*b*, 15*c*. It will be appreciated that in other embodiments more or less slots and/or pins may be provided, such as for additional support (e.g. an additional parallel slot with a corresponding additional pin) or to provide increased space for a slot (e.g. an axially shorter helical path). The sleeve 13 is axially and rotationally movable relative to the housing 14 along a path defined by each slot 15*a*, 15*b*, 15*c*. Here the sleeve 15 is axially biased in an uphole direction by a biasing means in the form of a spring 48 associated with a piston 50 that is also biased in the same direction by fluid pressure in a chamber 51 that is isolated from internal fluid by seals 53 but exposed to external fluid pressure via ports 52 to annulus 54.

Each berth 36, 38, 40, 42, 44, 46 is accessible from or via the flowpath, such as by movement of the indexer 12 in the throughbore 22. It will be appreciated that when an aperture 19 in the indexer 12 passes each berth 36, 38, 40, 42, 44, 46 sufficiently, any ball 16 in the berth 36, 38, 40, 42, 44, 46 is released into the flowpath in the throughbore 22. In addition, each berth 36, 38, 40, 42, 44, 46 is accessible externally to allow configuration of the apparatus by inserting the flowable object/s 16 into the/each selected berth 36, 38, 40, 42, 44, 46. As can be seen in FIG. 2, each berth 36, 38, 40, 42, 44, 46 is accessible via a sealable opening 56*a*-56*f* facilitating the configuration or reconfiguration of the apparatus 10, such as prior to, during or even after string 18 assembly, such as at surface/wellhead.

Each berth 36, 38, 40, 42, 44, 46 corresponds to a sequentially-arranged object position for the ball/s 16. Here, the berths 36, 38, 40, 42, 44, 46 and object positions are evenly axially distributed, providing an easy simultaneous overview of the for the operator when configuring the apparatus 10, as can be seen in FIG. 2.

Figure 3:
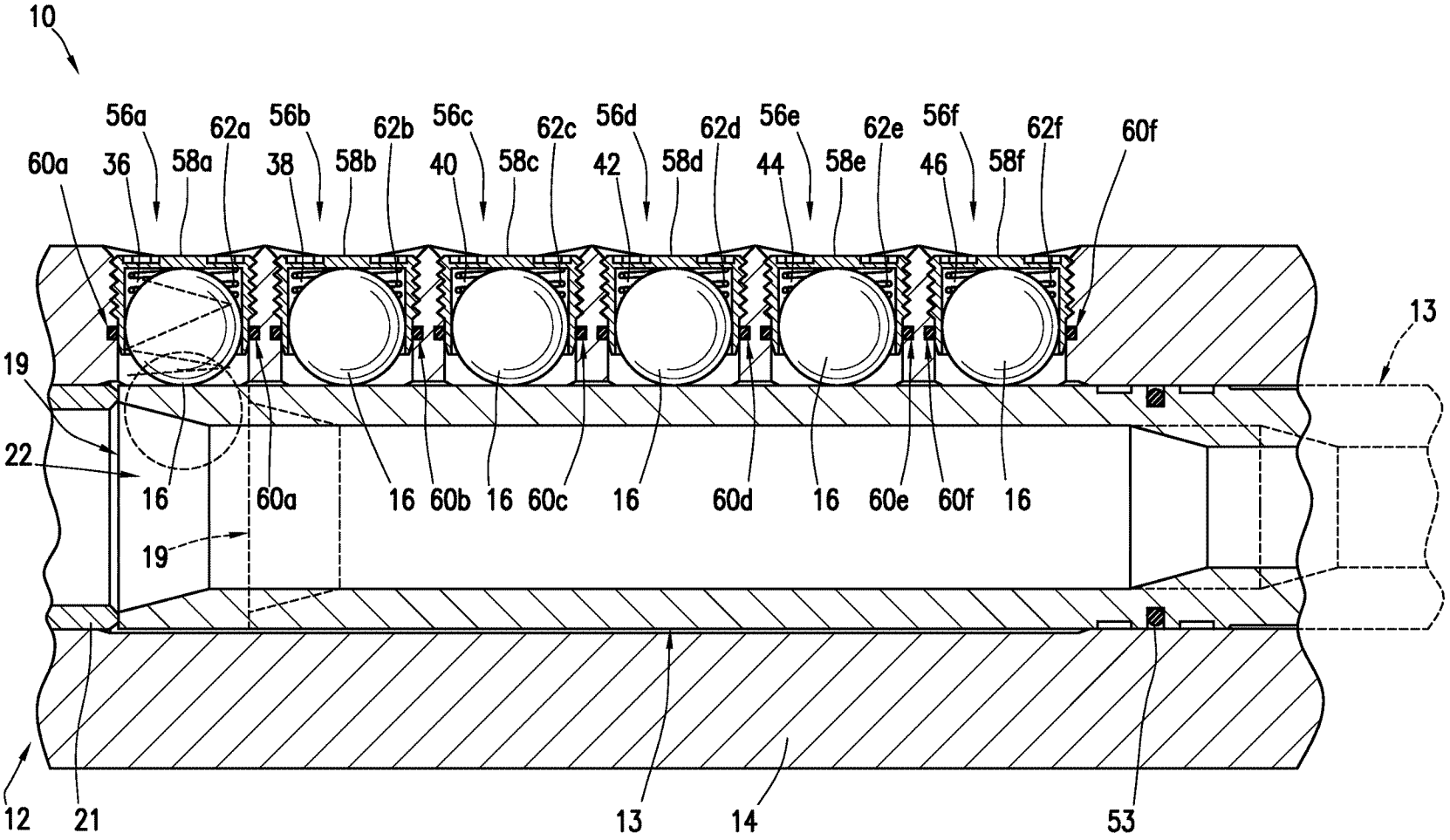
FIG. 3 is a detail sectional view of a portion of the apparatus of FIG. 1.

As can be seen in FIG. 3, in the embodiment shown, each opening 56*a*-56*f* is sealable with a respective covering member 58*a*-58*f* comprising a screw-in cap that engages a berth seal 60*a*-60*f* in each berth 36, 38, 40, 42, 44, 46. Alternative or additional sealing and/or securing means may be used to fix the covering members 58*a*-58*f* in place (e.g. an adhesive, clip, pin or the like, such as an adhesive applied to the screwthread). Here each covering member 58*a*-58*f* comprises a biasing member in the form of a ball-biasing coil spring 62*a*-62*f*. The coils springs 62*a*-62*f* bias any flowable object 16 in the respective berth 36, 38, 40, 42, 44, 46 towards the flowpath in the throughbore 22. The coil springs 62*a*-62*f* are suitably dimensioned and stiff to bias and propel the associated ball 16 towards and into the flowpath from a low side of the flowpath, such as in a deviated or horizontal bore to overcome gravity. The coil springs 62*a*-62*f* are dimensioned and configured to prevent extension of the coil springs 62*a*-62*f* into the flowpath before, even after propulsion of the ball 16 into the flowpath. Accordingly the coil springs 62*a*-62*f* cannot engage the indexing sleeve or other apparatus that may be in the throughbore, and undesired interference to downhole operations may be prevented, that may otherwise occur such as with damage to the coil springs 62*a*-62*f* potentially resulting in debris or fragments in the throughbore. When the aperture 19 in the indexer 12 passes each berth 36, 38, 40, 42, 44, 46 sufficiently, any ball 16 in the respective berth 36, 38, 40, 42, 44, 46 is propelled into the flowpath in the throughbore 22 by the associated coil spring 62*a*-62*f*, as schematically illustrated by the broken lines for the ball 16 at the first berth 36, where the coil spring 62*a* in an extended configuration is also schematically illustrated in broken line and shown not extending radially beyond the berth 36 into the throughbore 22. A portion of the indexer sleeve 13 is additionally shown in broken line following transition from the initial configuration at the first point of the first indexing position to a second point of the first indexing position, with the sleeve opening 19 having fully passed the first berth 36 to allow the release of a ball 16 from the first birth 36 into the flowpath in the throughbore 22.

Figure 4:
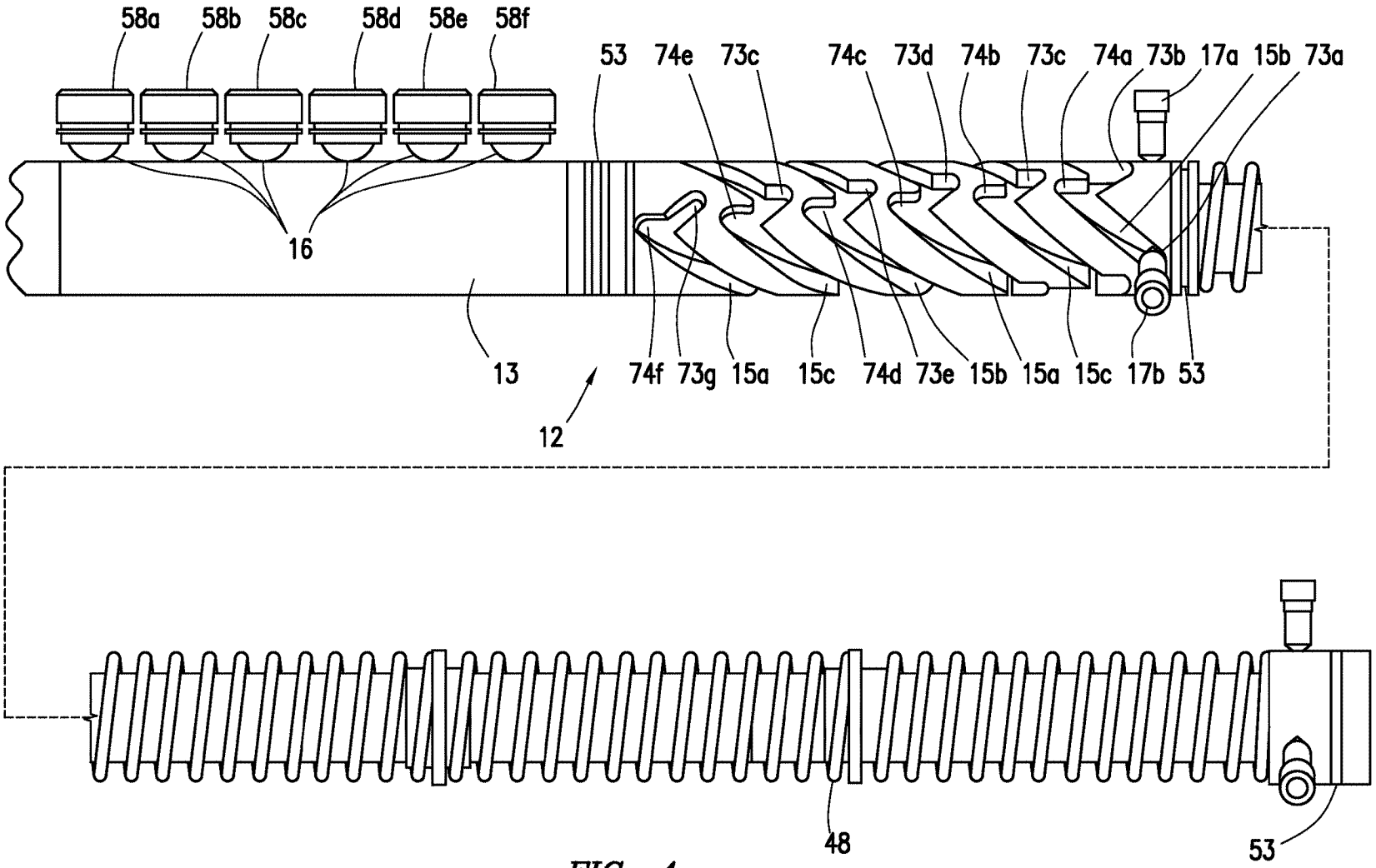
FIG. 4 is a partial view of an indexing portion of the apparatus of FIG. 1, with a housing removed for clarity.
Figure 5:
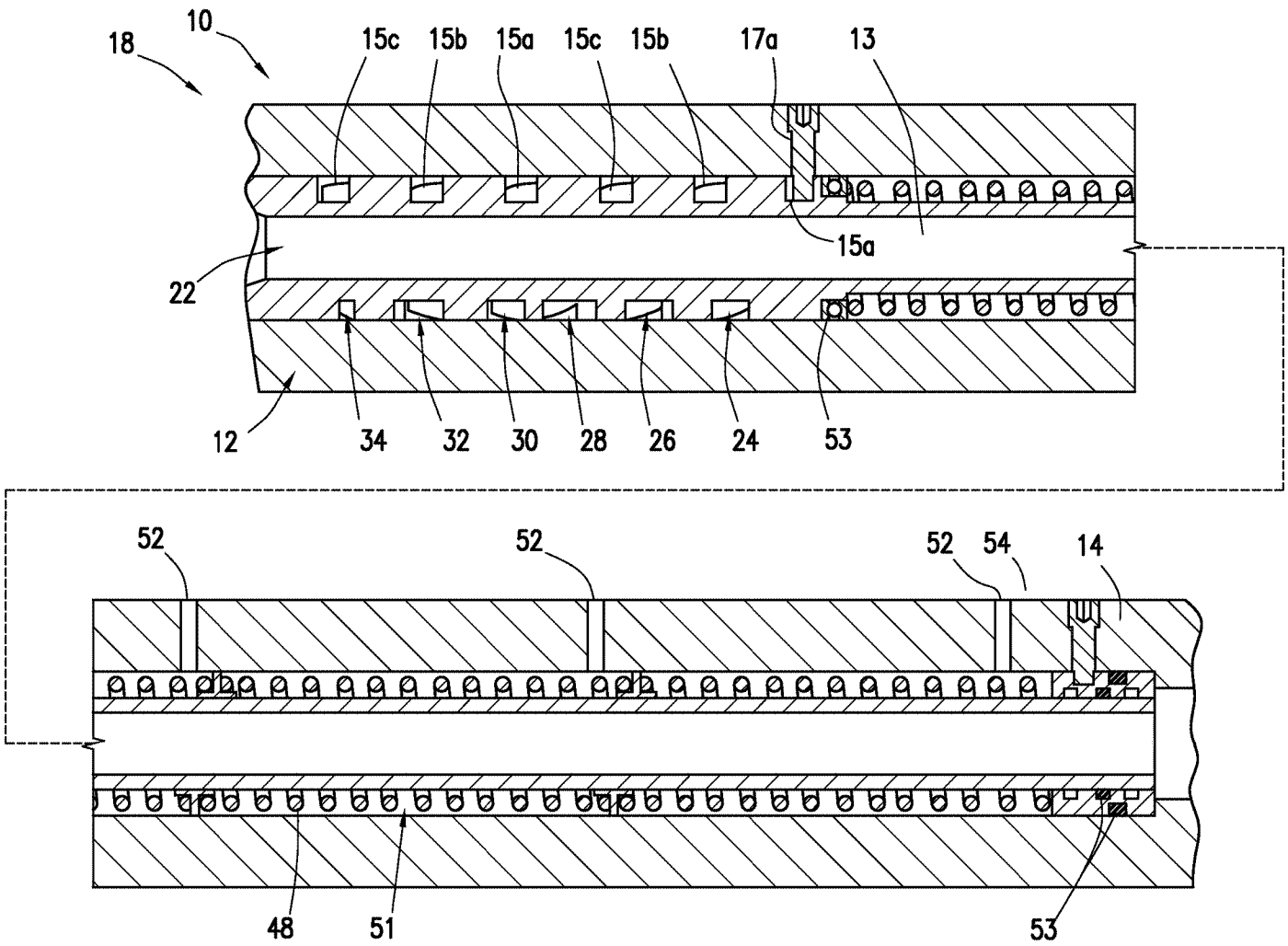
FIG. 5 is a sectional view of the indexing portion of the apparatus of FIG. 1, shown in the housing, with the apparatus shown at a first indexing point.
Figure 6:
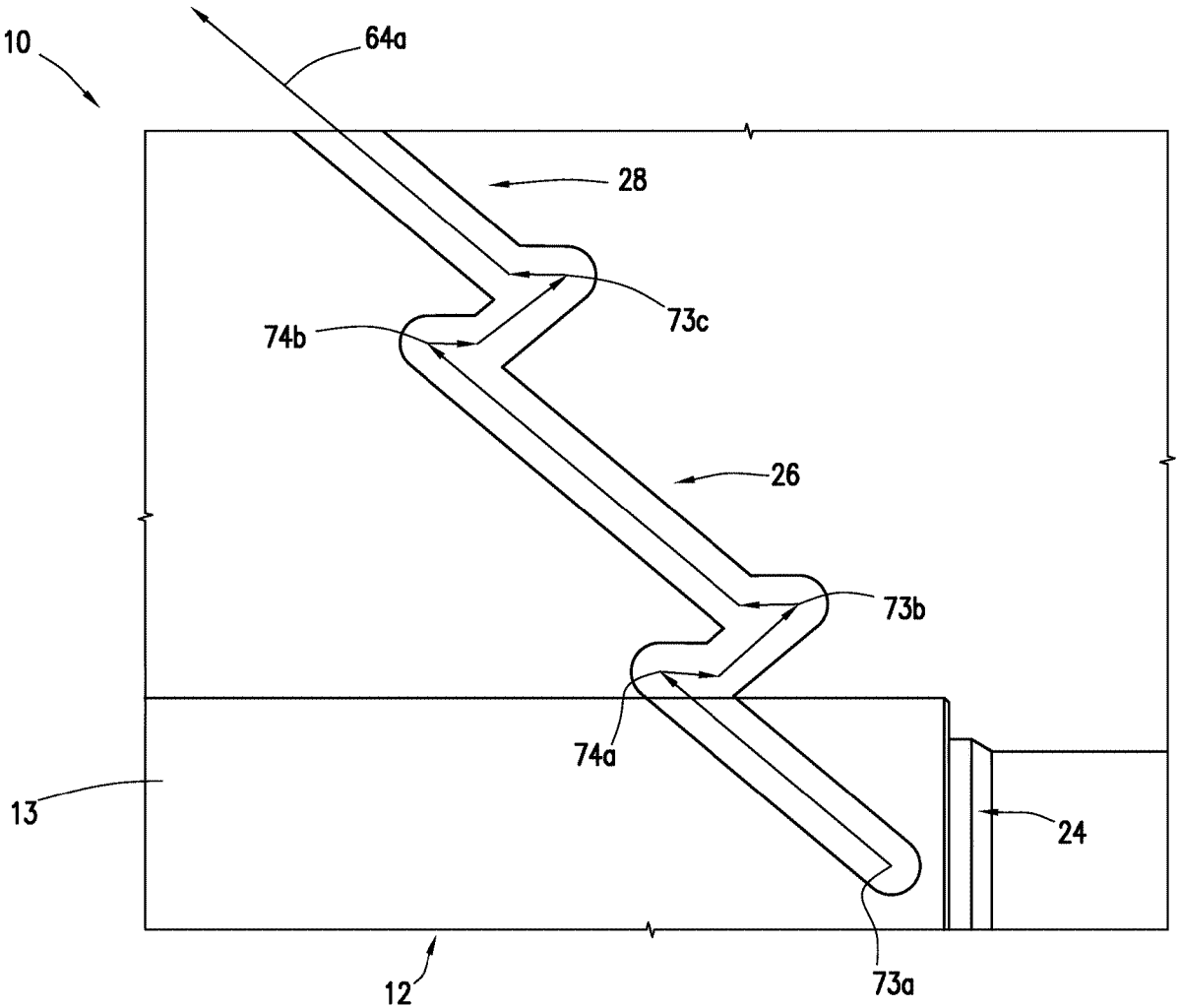
FIG. 6 is a schematic view of a portion of a path of a pin relative to a slot of the indexing portion of the apparatus of FIG. 1.

FIGS. 4 and 5 show the indexer 12 in more detail, where it can be seen that, here, the slots 15*a*, 15*b*, 15*c* define cycles having at least two sequential indexing points, wherein each indexing point corresponds to an operational state or condition. The slots 15*a*, 15*b*, 15*c* each define a finite path 64*a*, 64*b*, 64*c*, which are generally helical or helically arranged as will be appreciated from FIG. 6. It will also be appreciated that the single path 64*a* shown in FIG. 6 is replicated evenly three times around the sleeve 13 shown. The additional slots 15*b*, 15*c* with corresponding guide pins 17*b*, 17*c* and defining paths 64*b*, 64*c* are provided for distributing load transmitted between the housing 14 and the indexer 12, such as due to fluid pressure or fluid pressure differentials.

The indexer 12 is configured to transition from an initial axial and radial position as shown in FIGS. 4 and 5 to a final axial and radial position (not shown) through the plurality of cycles. Upon completion of the plurality of cycles the indexer 12 is effectively locked or inactuatable in the final position corresponding to the final cycle of the plurality of cycles. Upon completion of the plurality of cycles, the apparatus 10 is configured to permit further cycling operations that do not result in the further cycling or reverse cycling of the indexer 12. The indexer 12 may be reset or reconfigured, such as at surface following retrieval.

As will be appreciated from FIGS. 4 and 6 in particular, the indexer 12 is configured to sequentially progress in a single rotational direction (here, clockwise when viewed from an uphole position). Here, the indexer 22 sequentially progresses between indexing positions in a downhole direction corresponding to the clockwise rotation.

Here, the indexer 12 is also configured to sequentially progress between indexing points in a single rotational direction (clockwise). However, the indexer 12 is configured to sequentially progress between consecutive indexing points within each cycle in different axial directions. The indexer 12 progresses from the first indexing points to the respective second indexing points in a first axial direction (here, downhole) and progresses from the respective second indexing points to the next first indexing points (of the next indexing positions) in a second axial direction (here, uphole).

The indexer 12 is configured to sequentially index according to a predetermined operating parameter, which is a fluid condition here. Each respective first indexing point 73*a*-73*f* corresponds to the first fluid condition, which is a no flow or low flow condition here. Each respective second indexing point 74*a*-74*f* corresponds to the second fluid condition, which is a high flow or full flow condition here. In the configurations and arrangements shown in the Figures here, a pressure differential is generated in the form of a pressure drop associated with difference in diameter of the from the bore of the two sealing 53 diameter type-piston indexer to the outside of the casing in the wellbore annulus. When the pressure differential is increased sufficiently to overcome the biasing force of the spring 48 and any fluid pressure in the chamber 51, the indexing sleeve 13 moves as a piston in a downhole direction. The pressure differential can be increased by increasing fluid flow in the throughbore 22, such as by turning pumps on or up (e.g. at an uphole or surface location) to transition from the first fluid condition to the second fluid condition. In other embodiments, the indexer 12 is associated with a flow restriction that generates a pressure differential across the indexer 12, such as an internal flow restriction generating a pressure drop within the throughbore 22.

Movement of the indexing sleeve 13 relative to the indexing pins 17*a* is controlled by the slots 15*a*, 15*b*, 15*c* such that the indexing sleeve 13 relatively rotates and translates from engagement of the pins 17*a* at the respective first indexing points 73*a*-73*f* to engagement between the sleeve 13 and the pins 17*a* at the respective second indexing points 74*a*-74*f* of each slot 15*a*, 15*b*, 15*c*. Similarly, when there is a transition from the second fluid condition to the first fluid condition (e.g. by turning the pumps down or off, but normally off), the pressure differential between the inside and outside areas of the indexer 22 drops and the biasing force generated by the spring 48 and any fluid pressure in the chamber 51 overcomes the downhole force of the pressure differential (normally will be zero pressure drop with flow normally off) across the indexer 12 and the indexing sleeve 13 is propelled relative to the indexing pins 17*a* from the second indexing points 74*a-f* to the next respective first indexing points 73*b-f* (noting that there is no return to a previous first indexing point 73*a*-73*f* after the indexer 12 has been cycled to the corresponding second indexing point 74*a*-74*f*). In the embodiment shown each pair of first and second indexing points 73*a*-73*f*, 74*a*-74*f* corresponds to a respective first to sixth indexing cycle and cycling position. In the embodiment shown, a ball 16 can be released from a respective berth 36, 38, 40, 42, 44, 46 whenever the sleeve 13 is indexed to a second indexing point 74*a*-74*f*. Such a downhole movement of the sleeve 13 causes the aperture 19 of the sleeve 13, defined by an annular end of the sleeve 13 in this embodiment, to fully pass a corresponding berth 36, 38, 40, 42, 44, 46 such that the sleeve 13 no longer blocks the passage of an associated ball 16 in the corresponding berth 36, 38, 40, 42, 44, 46 from passage into the throughbore 22. In the embodiment shown, the slots 15*a*, 15*b*, 15*c* are configured such that even when the sleeve 13 indexes to the next respective first indexing point 73*b-f* of the subsequent cycle, the aperture is located below the berth 36, 38, 40, 42, 44, 46 such that the sleeve does not cover any of the berth 36, 38, 40, 42, 44, 46. In the embodiment shown, each slot has an additional terminal first indexing point 73*g*, subsequent to the sixth and final second indexing point 74*f*. The additional terminal first indexing point 73*g* allows the apparatus 10 to be cycled to the first fluid condition without the sleeve 13 passing so far uphole (e.g. to the sixth first indexing point 730 that the sixth berth 46 becomes (partially) covered or closed by the sleeve 13.

As can be seen in FIG. 4, the first and second indexing points of each indexing position are rotationally misaligned. Each indexing position corresponds to a respective cycle with the indexer in a different rotational and/or axial location. Such rotational misalignment or staggering of the indexing points arranged circumferentially around the sleeve 13 reduces the total axial length required for the sleeve 13.

FIG. 6 shows a pin path 76 of the relative movement of the indexing pin 17 through the slot 15*a* from an initial first indexing point 73*a* corresponding to a first fluid condition (such as low-flow or pumps off during run-in) to a second indexing point 74*a* of the first cycle when the pumps are turned up or on, past the threshold to reach the second condition. The transition to the second indexing point of the first cycle could release a ball 16 from the first berth 36. However, the operator may not wish to release a ball 16 during the first cycle so did not locate a ball 16 in the first berth 36 at surface prior to the apparatus 10 being run-in. Accordingly no ball 16 is released during the first cycle, allowing the operator to carry out operations under the second fluid condition. For example, the operator may wish to test the pumps, or perform an operation where it is desirable to have full fluid flow, such as full flow for a drilling, coring, reaming, cleaning or flushing operation or the like. With each cycle the indexing pin 17 progresses relatively through the slot 15*a* along the pin path 76, noting that here that the slot 15*a* forming part of the sleeve 13 may move whilst the pin 17 could be stationary. During each cycle, when the sleeve 13 moves axially downhole during the transition from each first indexing point 73*a-f* to each second indexing point 74*a-f*, a corresponding berth 36, 38, 40, 42, 44, 46 is revealed by the aperture 19 of the sleeve 13 such that a ball 16 is released from each corresponding berth 36, 38, 40, 42, 44, 46 where an operator has selected to locate a ball 16 prior to apparatus run-in. The operator can perform a number of cycles before releasing a ball 16 corresponding to the berth 36, 38, 40, 42, 44, 46 selected for ball 16 placement prior to running-in the apparatus 10. For example, an experienced operator may be comfortable with testing the pumps only once and may wish to release a ball 16 during a second cycle, when the pumps are turned on for a second time (the first being for the test). Whereas a less experienced operator may wish to test the pumps two or three times prior to releasing a ball 16, so may select the third or fourth berth 36, 38, 40, 42, 44, 46 for ball 16 placement prior to run-in, resulting in the release of the ball on the third or fourth cycle—depending whether the operator wishes to test the pumps two or three times.

Figure 7:
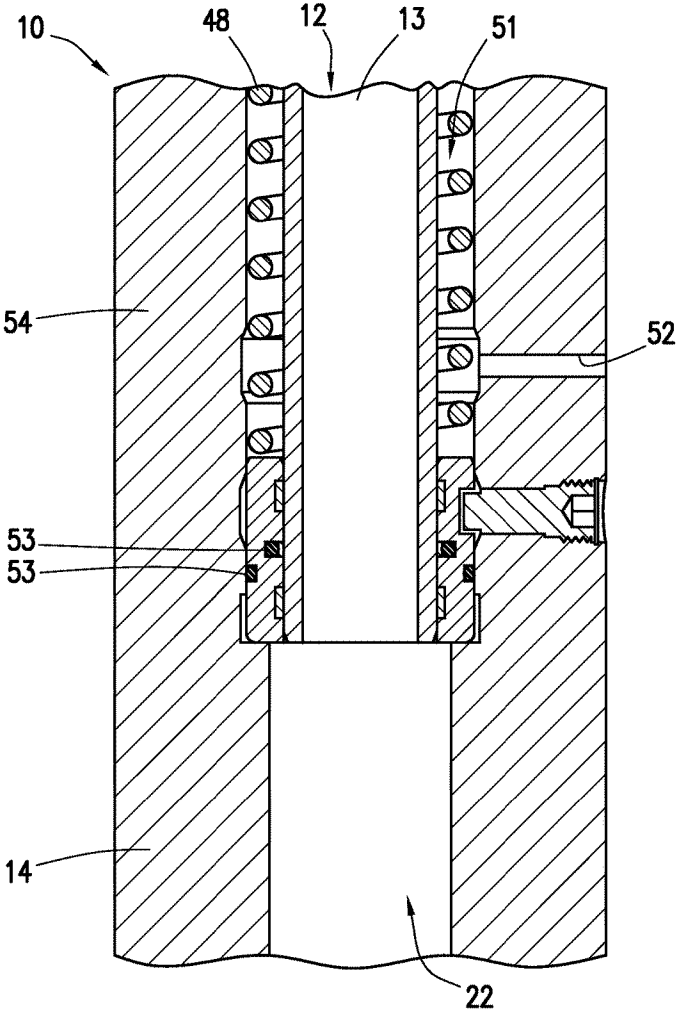
FIG. 7 is a detail view showing an end of the indexing portion of the apparatus of FIG. 1.

FIG. 7 shows a detail of two of the seals 53 for the chamber 51 housing the spring 48. The seals 53 isolate the chamber 51 from throughbore fluid and also prevent the passage of external fluid from the ports 52 to annulus into the throughbore 22. The inner seal 53 sealingly engages a lower portion of the indexing sleeve 13, which can translate downhole from the position shown in FIG. 7. The difference in diameter between the inner and outer seals 53 of the indexer 12 influences the pressure differential between inside and outside the indexer 12 (e.g. pressure in the throughbore 22 versus pressure in the chamber 51 in communication with the annulus 54) that affects the translation of the indexing sleeve 13 as a piston 50 (also considering the spring 48 biasing force and frictional forces).

Figure 8:
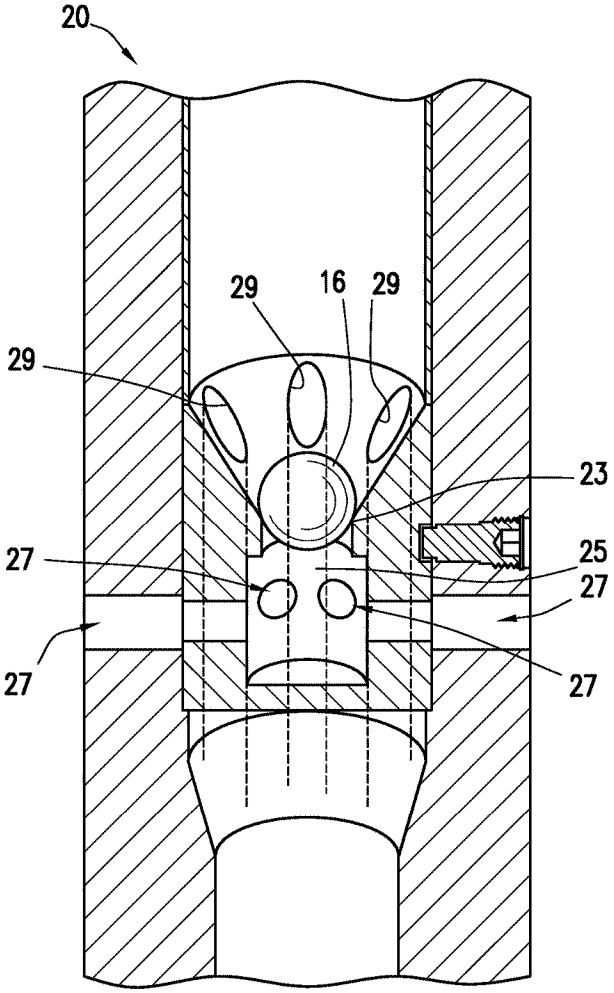
FIG. 8 is a partial cutaway view of a bypass valve for use with the apparatus of FIG. 1.
Figure 9:
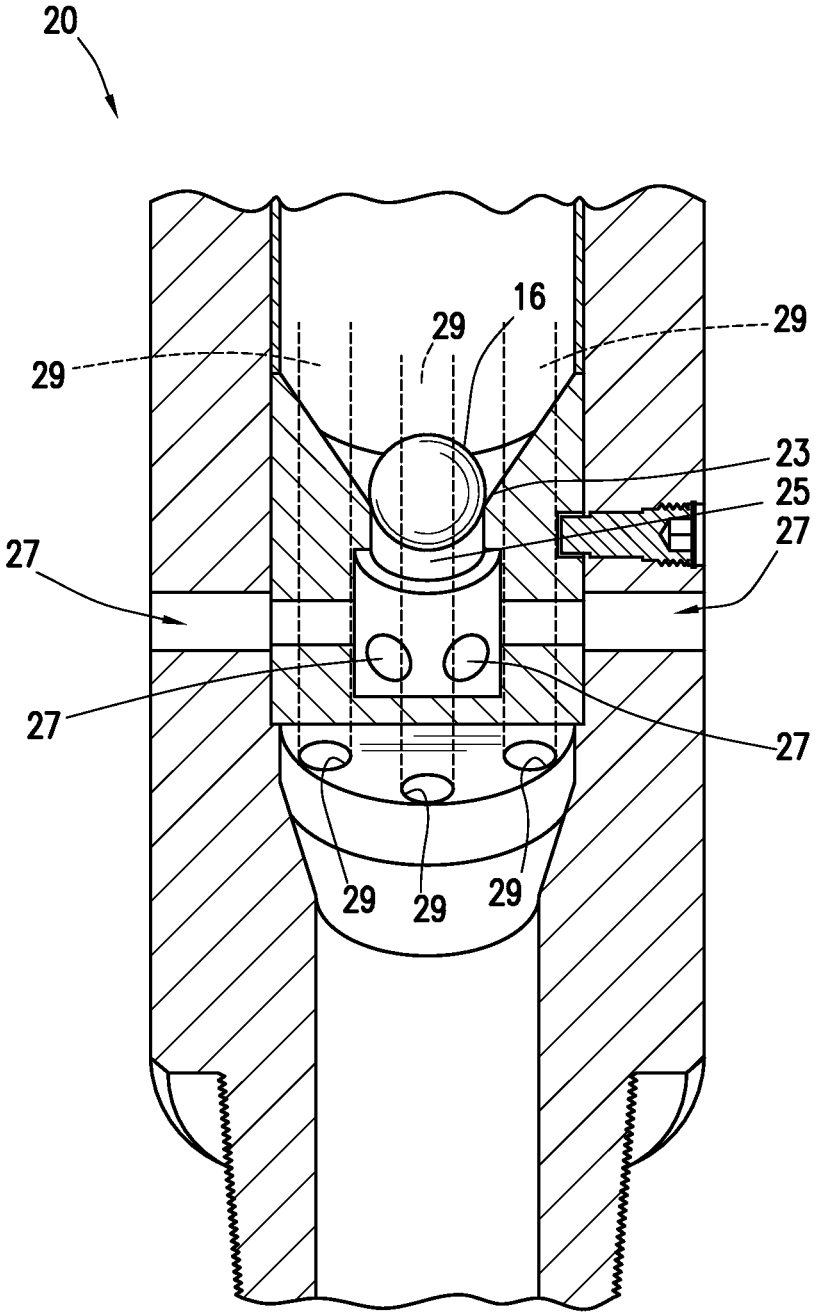
FIG. 9 is a partial cutaway view of the bypass valve shown in FIG. 8, viewed from an alternative direction.

FIGS. 8 and 9 show detail partial cut-away views of the bypass valve 20 that is located downhole of the apparatus 10 in the particular toolstring shown in FIG. 1. FIGS. 8 and 9 show the bypass valve 20 with a ball 16 seated in the valve 20 following release from the apparatus 10—released from the apparatus during the particular cycle selected by the operator prior to run-in. It will be appreciated that a valve seat 23 is located at a fluid passage 25 of the valve 20 such that prior to seating of the ball 16 in the seat 23, the fluid passage 25 allows the passage of fluid to a plurality of external ports 27 that allow a substantial portion of the fluid reaching the valve 20 (such as when being pumped downhole) to exit the toolstring 18 and not pass further downhole below the valve 20. The particular valve 20 shown also has a plurality of additional throughbores 29 (shown partially in broken lines) that are not operatively associated with the valve seat 23 or the ball 16 when seated in the valve. The throughbores 29 allow the passage of fluid through the valve 20 from above the valve 20 to below the valve 20 before and after seating of the ball 16 in the seat 23. When the central passage 25 is open only a portion of fluid flow through the valve 20 passes through the throughbores 29 to below the valve such that only a portion of fluid is allowed to reach apparatus below the valve 20. The valve 20 is configured such that an increase in fluid pressure or increased flow causing an increased pressure differential across the valve 20, such as can be associated with turning pumps on or full flow, increases fluid exiting the toolstring 18 via the external ports 27 such that the fluid passing through the throughbores 29 does not exceed a threshold that may actuate fluid-actuated apparatus that may be positioned downstream (downhole) of the valve 20. However, once the operator wishes to operate the valve 20, the operator cycles a sufficient number of times corresponding to the pre-selected number, in order to release a ball 16 from the appropriate berth 36, 38, 40, 42, 44, 46. The released ball 16 flows downhole in the throughbore 22 to seat in the valve 20. Once seated in the valve 20, the ball 16 blocks the flow of fluid to the external ports 27 such that all flow is then directed through the throughbores 29 to below the valve 20. Accordingly, the fluid conditions may now be controlled to increase fluid flow and/or pressure to actuate fluid-actuated apparatus below the valve 20, such as in the toolstring 18 below the valve 20.

Figure 10:
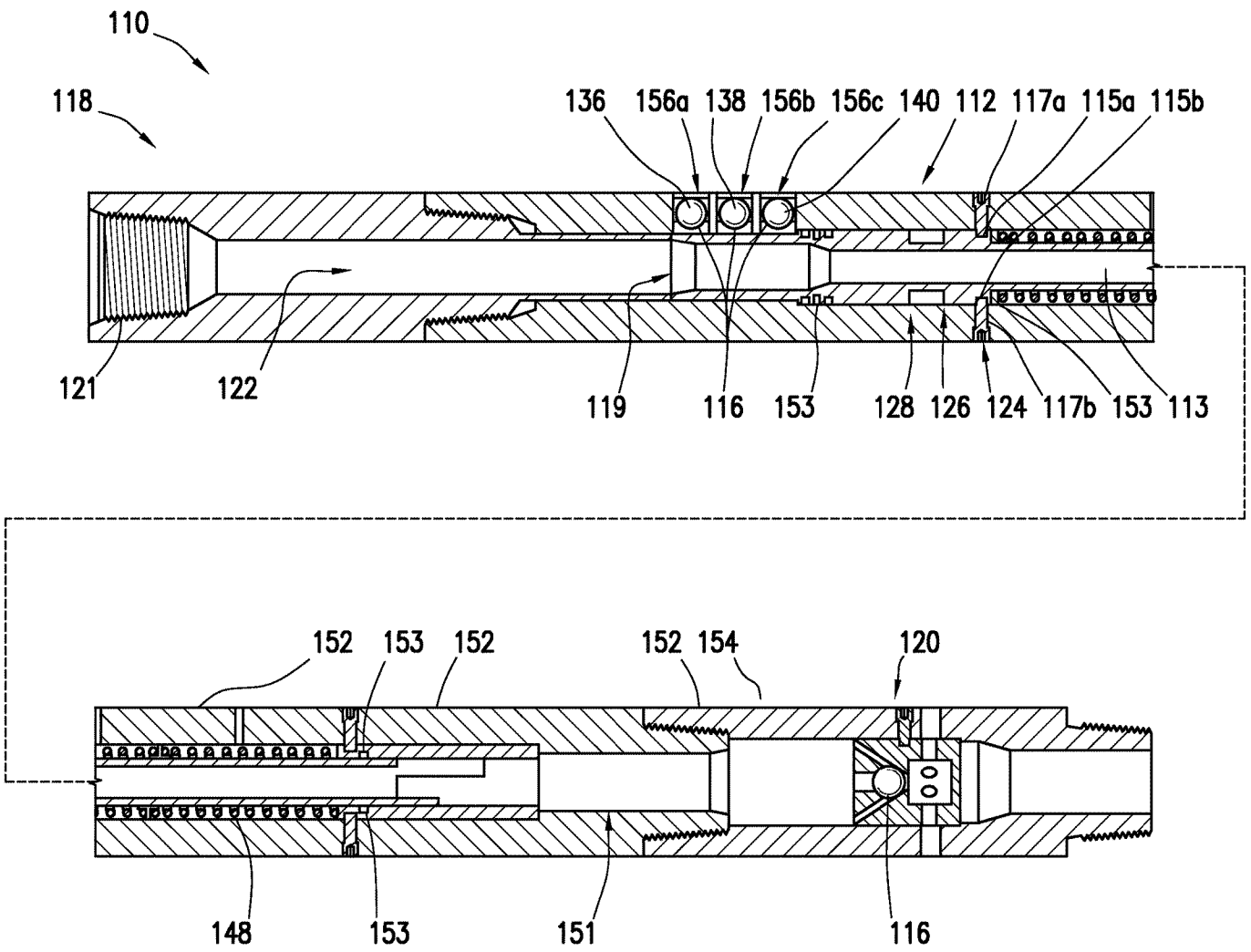
FIG. 10 is a schematic sectional view of a second embodiment of an apparatus according to the invention incorporated in a portion of a toolstring.
Figure 11:
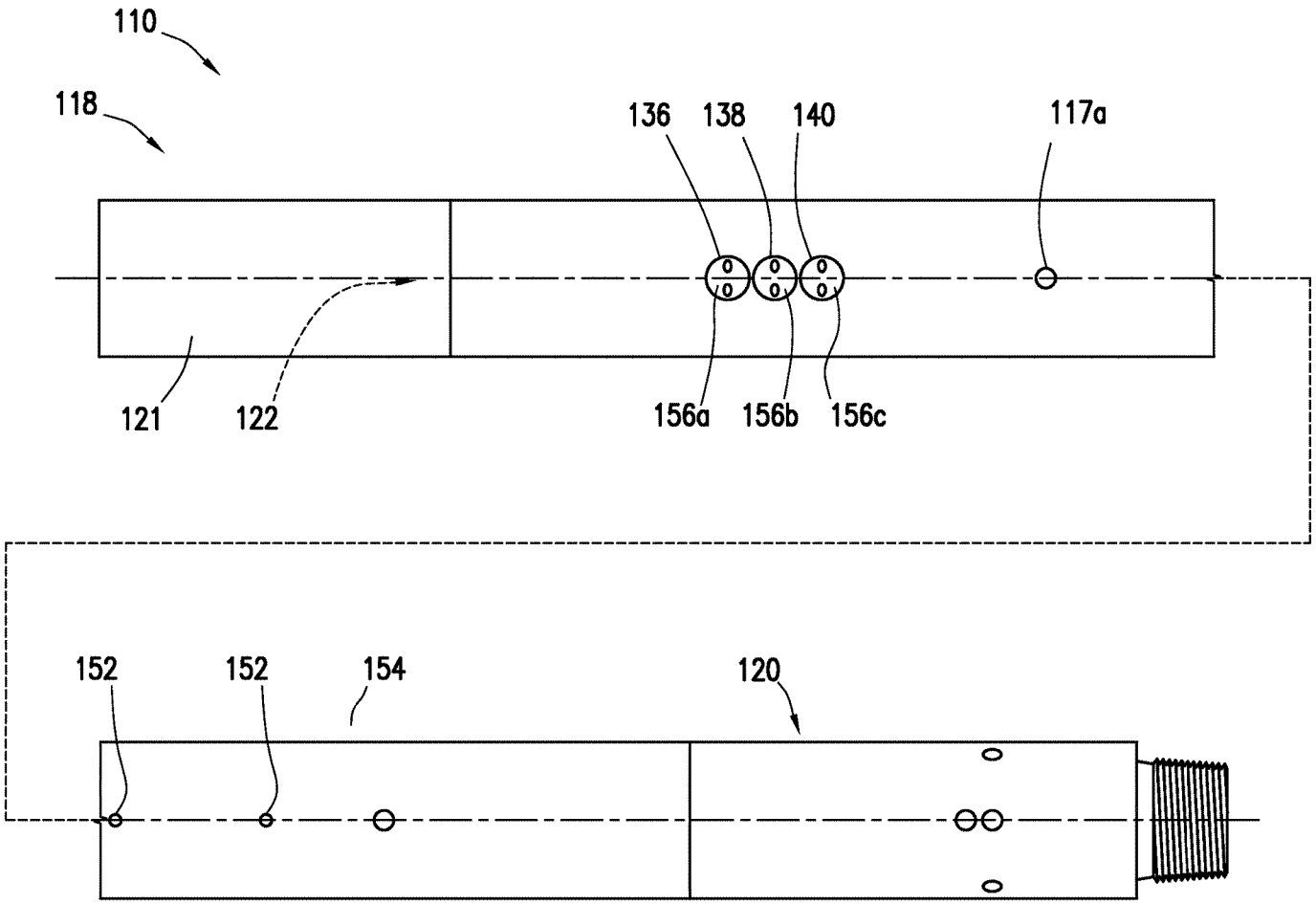
FIG. 11 is a side view of the apparatus of FIG. 10.

FIGS. 10 and 11 show a second embodiment of an apparatus 110 according to the present invention. The apparatus 110 is generally similar to that shown in FIG. 1, with similar features referenced by similar numerals incremented by one hundred, such as tool string 118, aperture 119, running tool 121, throughbore 122, spring 148, chamber 151, ports 152, annulus 154, openings 156*a-c*, path 164*a*, and indexing points 173*a-c*. Accordingly, the apparatus 110 comprises an indexer 112 in a housing 114, and one or more flowable objects shown here as a plurality of drop-balls 116.

In the particular embodiment shown in FIG. 10, there are only three indexing positions 124, 126, 128, corresponding to release positions for a drop-ball 16 from each of three berths 136, 138, 140. It will be appreciated again that in practical applications less drop-balls 116 may be present than shown; and drop-balls 116 are shown here at every berth 136, 138, 140 corresponding to every indexing position 124, 126, 128 and also seated following release, for illustrative purposes only. In many applications, only a single drop-ball 116 may be present—located at any of the positions shown in FIG. 10 according to a berth 136, 138, 140 selection and a stage of operation. For example, it will be appreciated that the released ball 116 shown seated in a bypass valve 120 in FIG. 1 is purely illustrative and would require the indexer 112 to be progressed through at least a first cycle corresponding to the first indexing position 124 (not yet shown in FIG. 10).

Figure 15:
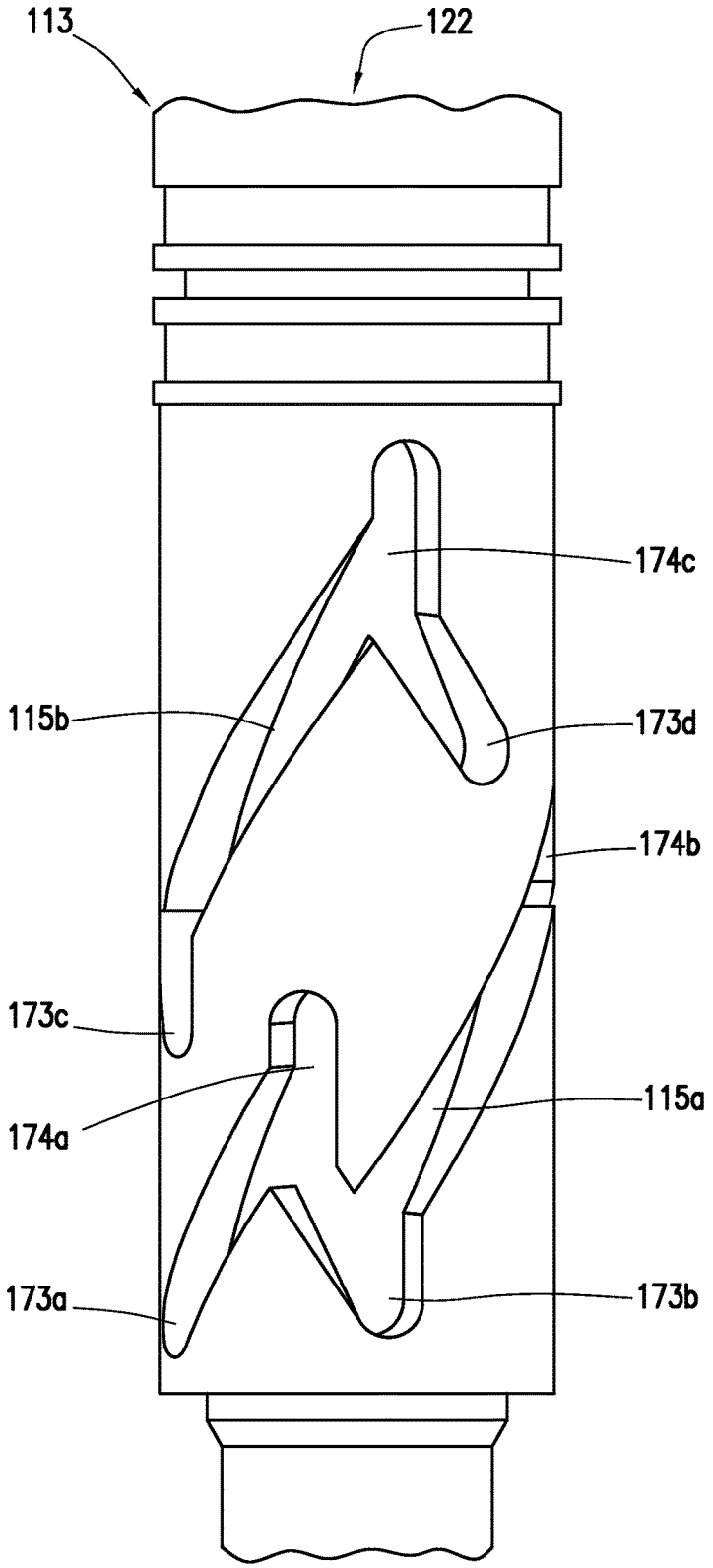
FIG. 15 is a detail view of a part of the indexing portion of the apparatus of FIG. 10, shown without the housing.

The operation of the apparatus 110 shown in FIGS. 10 and 11 is generally similar to that of the apparatus shown in FIGS. 1 to 9, noting however that the operator only has three berths 136, 138, 140 for the selective location of a drop-ball 116. Accordingly, an operator is limited to a maximum of two redundant berths 136, 138 prior to release of a ball 116 from the third berth 140. Accordingly, an operator may cycle a maximum of two times without releasing a ball 116. The total axial length of the apparatus 110 shown in FIGS. 10 and 11 is shorter than the apparatus 10 shown in FIGS. 1 and 2, noting that the length required for the additional indexing cycles and corresponding first and second indexing points of the slots 115*a*, 115*b* is reduced (and not as many berths 136, 138, 140 are required). It can also be seen from FIG. 15 that the sleeve 113 comprises only a pair of parallel slots 115*a*, 115*b* such that there are only two corresponding guide pins 117*a, b*.

Figure 12:
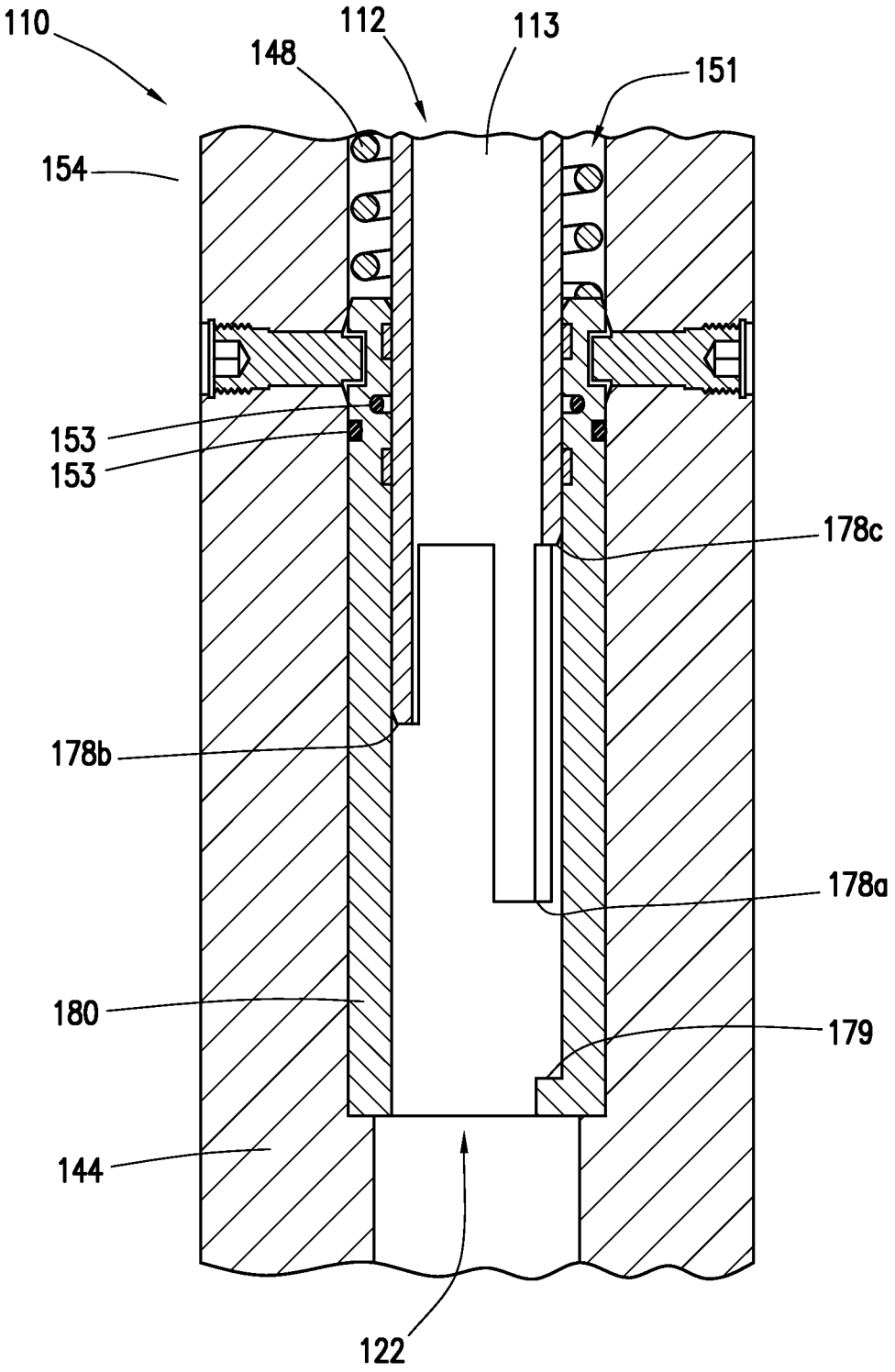
FIG. 12 is a detail sectional view of an end of an indexing portion of the apparatus of FIG. 10 showing support members within a housing of the apparatus.
Figure 13:
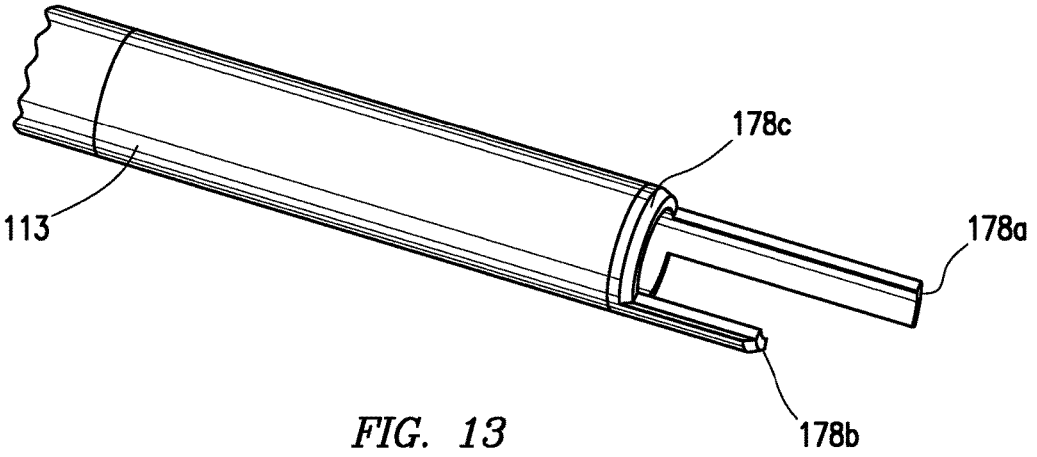
FIG. 13 is a view of the end of the indexing portion of the apparatus of FIG. 10 shown without the housing.
Figure 14:
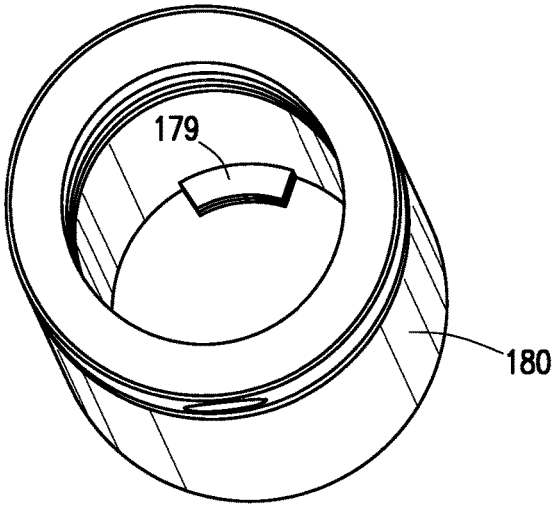
FIG. 14 is a view of a support member for fixing to the housing shown without the housing.

FIG. 12 shows the arrangement of seals 153 generally similar to those shown in FIG. 7. In addition, FIGS. 12 and 13 illustrate axial stops in the form of landing shoulders 178*a*, 178*b*, 178*c* configured to engage a corresponding support 179 on an axially fixed member 180, shown in FIG. 14. Each indexing position comprises a respective landing shoulder 178*a*, 178*b*, 178*c*, with the landing shoulders 178*a*, 178*b*, 178*c* arranged in a similar pattern to the arrangement of the respective second indexing points 174*a*, 174*b*, 174*c*. Accordingly, whenever the sleeve 113 is transitioned to a second indexing point 174*a*, 174*b*, 174*c*, the corresponding landing shoulder 178*a*, 178*b*, 178*c* engages the support 79 on the axially fixed member 180. Each 178*a*, 178*b*, 178*c* allows the transmission of axial force between the sleeve 113 and the housing 114 without passing through the indexing pins 117*a, b*. Accordingly the indexing pins 117*a, b* are protected from high forces and stresses that may otherwise be associated with the sleeve 113 when at or transitioning to the second indexing points 174*a-c* (e.g. with the pumps turned on suddenly for maximum flow).

Figure 16:
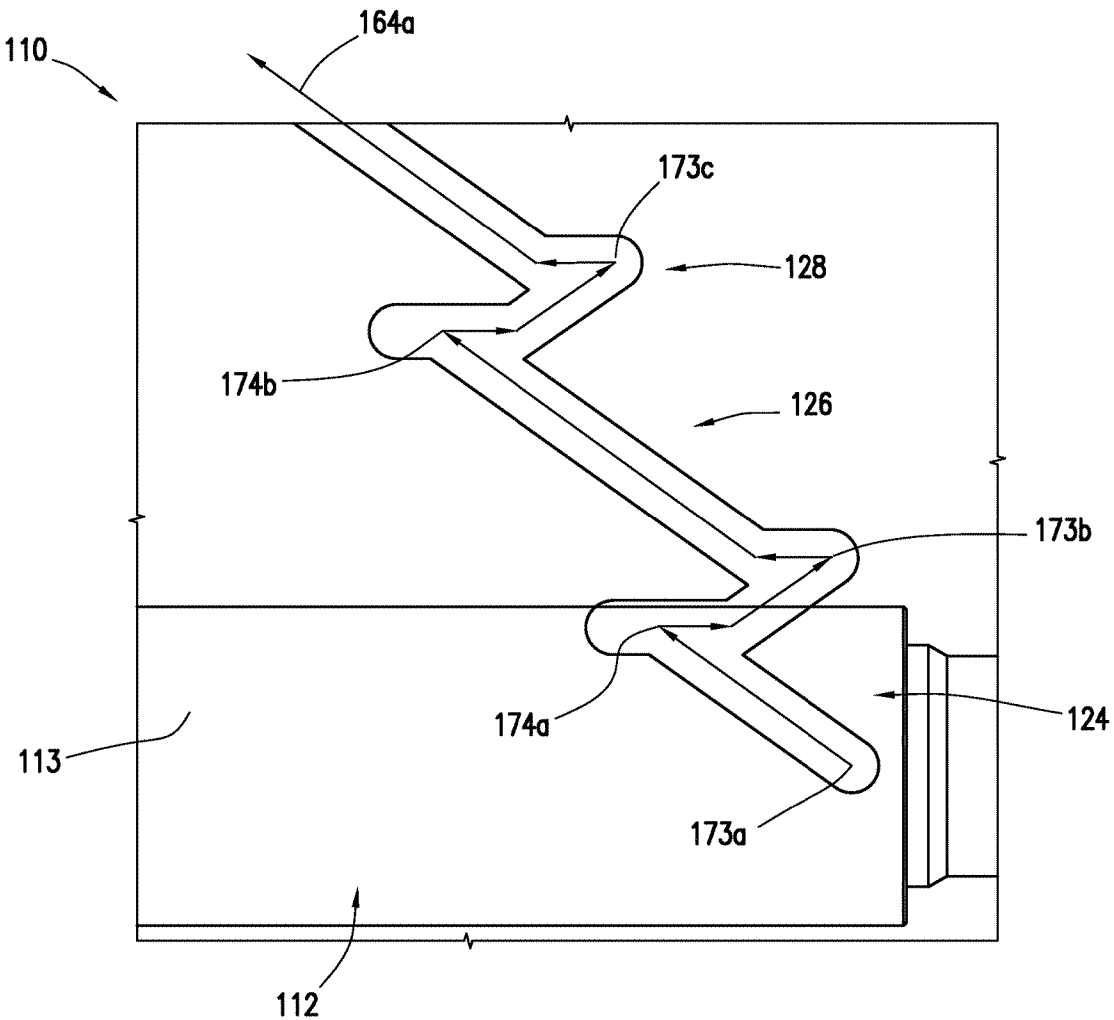
FIG. 16 is a schematic view of a portion of a path of a pin relative to a slot of the indexing portion of the apparatus of FIG. 10.

The sequential cycling is illustrated with a pin path 176 in FIG. 16, generally similar to that shown in FIG. 6, noting that an additional axial clearance is provided in the slots 115*a*, 115*b* at the second indexing points 174*a*-174*c* to allow the respective landing shoulders 178*a-c* to engage the corresponding support 179 on the fixed member 180 prior to axial engagement of the indexing pins 117*a, b* with the end walls of the slots 115*a*, 115*b* at the second indexing points 174*a-c*. Accordingly, the transmission of the highest axial forces between the sleeve 113 and the housing 114 is transferred through the landing shoulders 178*a-c*, thus protecting the indexing pins 117*a, b*. As with the apparatus 10 of FIG. 6, an additional terminal indexing point 173*d* is provided.

Figure 17:
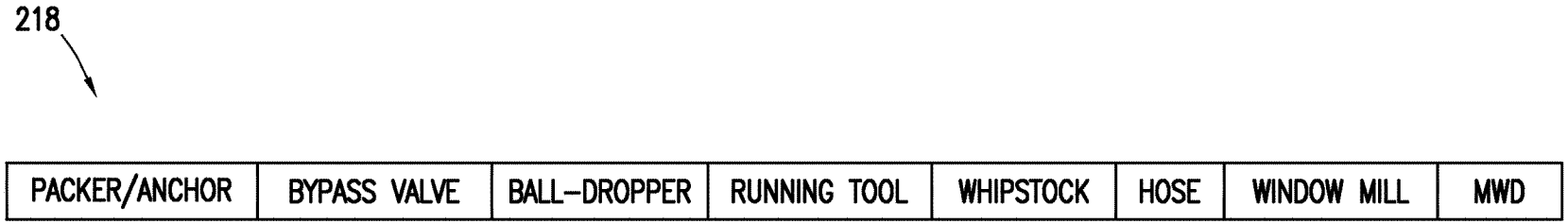
FIG. 17 is a diagrammatic view of a toolstring incorporating the apparatus of the present invention.
Figure 18:
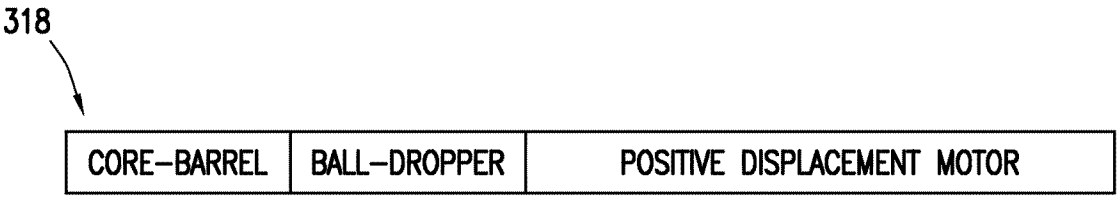
FIG. 18 is a diagrammatic view of a second toolstring incorporating the apparatus of the present invention.

Exemplary toolstrings 218, 318 incorporating the apparatus 10, 110 of FIG. 1 or 10 are schematically illustrated in FIGS. 17 and 18. In the toolstring 218 of FIG. 17, the apparatus is incorporated into a toolstring 218 for a sidetracking operation. The apparatus 10, 110 is configured at surface for release of a ball 16, 116 during a desired particular cycle in a sequence of cycles. The toolstring 218 is run-in to a location where it is desired to perform a sidetracking operation. The flow may then be turned on to send data from the MWD to surface. The data can be used for any required rotation to align the whipstock face (which has been scribed at surface prior to run-in relative to the tool face datum of the MWD). This initial turning on of flow cycles the apparatus 10, 110 a first time. However, the operator has selected not to locate a ball 16, 116 in the first berth 36, 136. Accordingly, no ball 16, 116 is released when the flow is initially turned on to retrieve the MWD data. Once the whipstock face has been positioned and aligned, the slips can be set in the anchor or packer by fluid actuation following cycling the apparatus 10, 110 sufficiently to release a ball 16, 116 to seat in the valve 20, 120. Thereafter a sidetracking operation may be performed, such as by pulling the string 218 upwards to snap the hose between the whipstock and the mill such that rotation of the string causes the mill to rotate relative to the fixed whipstock and the casing can be milled out, guided by the whipstock. The apparatus 10, 110 provides an operator with flexibility at rigsite. For example, if an operator is uncertain about the reliability of a MWD tool, the pumps may be turned on several times to check the alignment of the whipstock without releasing a ball 16, 116.

In the toolstring 318 of FIG. 18, the apparatus 10, 110 is incorporated into a toolstring 318 for a coring operation. The apparatus 10, 110 allows flow for a selected number of cycles, such as for flushing out the bore of the core-barrel. When it is desired to seal off the internal bore of an inner barrel of a coring barrel, the apparatus 10, 110 can be cycled the selected number of times to release a ball 16, 116. The apparatus 10, 110 allows the operator rigsite flexibility to determine the number of fluid cycles that can be operated prior to release of the ball 16, 116. Accordingly, additional fluid cycles may be incorporated into the coring operation as desired. In the particular embodiment shown, a positive displacement motor is used for coring, noting that the positive displacement motor would otherwise block or impede a drop-ball 16, 116 from uphole, such as dropped from surface. In this coring configuration, a restriction nozzle below or inside the indexer piston 50, 150 may be used in place of a bypass valve 20, 120 to generate a greater pressure drop from inside the indexer 12, 112 to the annulus to cycle the indexer piston 50, 150.

It will be appreciated that the apparatus 10, 110 are reconfigurable such that the predetermined cycle selected from the sequence of cycles can be varied between configurations. Following a first downhole deployment, the apparatus 10, 110 may be retrieved if desired, and reconfigured at surface before or during string assembly and/or run-in, for a next downhole trip. Alternatively, the apparatus 10, 110 may be left downhole.

It will be apparent to those of skill in the art that the above described embodiments are merely exemplary of the present invention, and that various modifications and improvements may be made thereto, without departing from the scope of the invention. For example, where a drop-ball has been illustrated, other flowable objects may be used in other embodiments, such as plugs, darts or the like.

It will be appreciated that any of the aforementioned tools may have other functions in addition to the mentioned functions, and that these functions may be performed by the same tool.

Where some of the above apparatus and methods have been described in relation to particular fluid-actuated tool; it will readily be appreciated that a similar apparatus may be for use with other downhole tools, such as reaming, drilling, cleaning, and/or injection tools, or the like.

Where features have been described as downhole or uphole; or proximal or distal with respect to each other, the skilled person will appreciate that such expressions may be interchanged where appropriate. For example, the skilled person will appreciate that where the indexer is biased uphole in the embodiments shown; in an alternative embodiment, the indexer may be biased downhole. Accordingly, the indexer may move progressively uphole when indexing.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A downhole actuating apparatus for actuating downhole, the apparatus comprising:

a housing comprising a throughbore defining a flow path; and at least one flowable object retained within the housing away from the throughbore defining the flow path;

wherein the actuator is actuatable at a downhole location at, upon, or during one or more particular cycles selectable from a sequence of cycles according to a predetermined selection;

the downhole actuation comprising the release of the at least one flowable object from the housing at the downhole location into the flow path, wherein the apparatus is configured to release the at least one flowable object from the housing at the downhole location at, upon or during the particular cycle selectable from the sequence of cycles.

2. The apparatus of claim 1, wherein the apparatus comprises a controller for controlling the release of the flowable object at, upon or during the predetermined cycle selectable from the sequence of cycles.

3. The apparatus of claim 2, wherein the controller is selected from one or more of: a mechanical controller; and a fluid operated controller.

4. The apparatus of claim 1, wherein the apparatus is reconfigurable such that the predetermined cycle selected from the sequence of cycles varies between configurations.

5. The apparatus of claim 4, wherein the apparatus is reconfigurable to allow variation of the particular predetermined cycle between different downhole trips.

6. The apparatus of claim 1, wherein the flowable object comprises an actuating member, selected from one or more of: a drop-ball, a dart, a plug, and an RFID tag.

7. The apparatus of claim 1, wherein the apparatus is fluid-actuated or fluid-controlled, the release of the flowable object being triggered by a fluid cycle or operation.

8. The apparatus of claim 7, wherein the one or more particular cycles comprises one or more fluid cycle.

9. The apparatus of claim 1, wherein the sequence is selectable at one or more of: prior to or during string assembly, and before or during string run-in.

10. The apparatus of claim 1, wherein the apparatus comprises a plurality of positions for the at least one flowable object, each object position corresponding to a particular cycle.

11. The apparatus of claim 10, wherein the apparatus comprises a plurality of ports, chambers or berths for the flowable object, each port, chamber or berth corresponding to each object position.

12. The apparatus of claim 11, wherein the apparatus is reconfigurable to accommodate different flowable objects in the port, chamber or berth.

13. The apparatus of claim 10, wherein multiple positions of the plurality of positions correspond to a similar respective phase of multiple cycles, the apparatus being configured to release the at least one flowable object at a similar phase, stage, juncture or point of each of the plurality of cycles.

14. The apparatus of claim 10, wherein the object positions are sequentially arranged.

15. The apparatus of claim 14, wherein the object positions are axially spaced and/or circumferentially spaced.

16. The apparatus of claim 10, wherein in use, at least one of the object positions is selected for redundancy or non-use.

17. The apparatus of claim 1, wherein the apparatus comprises a lock to prevent cycling prior to deactivation of the lock.

18. The apparatus of claim 1, wherein the apparatus comprises a multi-cycle downhole ball-dropper for dropping a ball from the downhole location at or upon an nth cycle of the sequence of cycles wherein "n" is selectable from the sequence of cycles.

19. The apparatus of claim 1, wherein the apparatus is configured to bias the at least one flowable object towards the flowpath.

20. The apparatus of claim 19, wherein the apparatus is configured to bias the at least one flowable object towards the flowpath from a low side of the flowpath.

21. The apparatus of claim 1, wherein the apparatus comprises an indexer, the indexer comprising an indexing mechanism and configured to sequentially progress from a particular indexing position corresponding to a respective cycle in the sequence to a next indexing position corresponding to the next respective cycle in the sequence.

22. The apparatus of claim 21, wherein each of indexing position corresponding to a respective cycle comprises the indexer in a different rotational and/or axial location.

23. The apparatus of claim 21, wherein the indexing mechanism comprises an indexing pin and an indexing sleeve having a slot, wherein the indexing pin engages the slot, and wherein the indexing sleeve is supported at each respective indexing position by a support member in addition to or instead of the indexing pin.

24. The apparatus of claim 23, wherein the support member comprises an axial stop configured to engage a corresponding support on an axially fixed member.

25. The apparatus of claim 23, wherein the slot defines a helically arranged finite path.

26. A downhole toolstring comprising the apparatus of claim 1.

27. The downhole toolstring of claim 26, wherein the downhole toolstring comprises one or more tools selected from: a valve; a packer; an anchor; a whipstock; a sidetracking tool; a coring tool; a downhole motor; a reamer; a drill bit; a running tool; a MWD tool.

28. A method of actuating a downhole apparatus, the method comprising:

configuring an apparatus having a housing comprising a throughbore defining a flow path, at least one flowable object retained within the housing away from the throughbore, and an actuator, by selecting a cycle from a sequence of cycles for the actuator to actuate at, upon or during said cycle;

running-in the apparatus to a downhole location with the downhole actuator in a predetermined configuration;

actuating the downhole actuator at the downhole location at, upon or during the preselected cycle such that the at least one flowable object is released from the downhole location into the flow path at, upon or during the cycle selected from the sequence.

29. The method of claim 28, wherein the method comprises selecting the cycle from any of the sequence of cycles.

30. The method of claim 28, wherein the method comprises varying the selected cycle for different trips and/or for different operators.

31. The method of claim 28, wherein the method comprises locating the at least one flowable object downhole of a restriction prior to release.

* * * * *